US006378739B1

(12) United States Patent
Maas et al.

(10) Patent No.: US 6,378,739 B1
(45) Date of Patent: Apr. 30, 2002

(54) PRECOMPRESSION SYSTEM FOR A LIQUID DISPENSER

(75) Inventors: Wilhelmus Johannes Maas; Petrus Lambertus Hurkmans, both of Someren (NL)

(73) Assignee: AFA Polytek, B.V. (NL)

( * ) Notice: Subject to any disclaimer, the term of this patent is extended or adjusted under 35 U.S.C. 154(b) by 0 days.

(21) Appl. No.: 09/459,033

(22) Filed: Dec. 10, 1999

Related U.S. Application Data

(60) Provisional application No. 60/123,045, filed on Mar. 5, 1999, provisional application No. 60/133,961, filed on May 13, 1999, provisional application No. 60/133,339, filed on May 10, 1999, provisional application No. 60/123,222, filed on Mar. 8, 1999, and provisional application No. 60/124,807, filed on Mar. 17, 1999.

(51) Int. Cl.[7] ..... B67D 5/40
(52) U.S. Cl. ..... 222/383.1; 222/341
(58) Field of Search ..... 222/341, 340, 222/207, 383.1, 383.3, 380, 381; 239/333

(56) References Cited

U.S. PATENT DOCUMENTS

| | | | | |
|---|---|---|---|---|
| 3,162,706 A | | 12/1964 | Cheney | 264/525 |
| 3,336,425 A | | 8/1967 | Valyi | 264/524 |
| 3,523,329 A | | 8/1970 | Gallay | 53/561 |
| 4,120,430 A | | 10/1978 | French | 222/234 |
| 4,129,235 A | | 12/1978 | Haas | 222/321 |
| 4,191,313 A | * | 3/1980 | Blake et al. | 222/335 |
| 4,241,853 A | * | 12/1980 | Pauls et al. | 222/207 |
| 4,489,861 A | * | 12/1984 | Saito et al. | 222/207 |
| 4,593,607 A | | 6/1986 | Bennett | 92/130 B |
| 4,662,544 A | | 5/1987 | Gillispie | 222/385 |
| 4,691,849 A | | 9/1987 | Tada | 222/382 |
| 4,993,214 A | | 2/1991 | Corba | 53/471 |
| 5,040,701 A | | 8/1991 | Knickerbocker et al. | 222/153 |
| 5,158,211 A | | 10/1992 | Meshberg | 222/153 |
| 5,201,726 A | | 4/1993 | Kirkham | 604/294 |
| 5,211,315 A | | 5/1993 | Geier | 222/383 |

(List continued on next page.)

FOREIGN PATENT DOCUMENTS

| | | |
|---|---|---|
| NL | 1010777 | 12/1998 |
| NL | 1010778 | 12/1998 |
| NL | 1011477 | 3/1999 |
| NL | 1011479 | 3/1999 |
| NL | 1011962 | 5/1999 |
| NL | 1011964 | 5/1999 |
| NL | 1013139 | 9/1999 |

*Primary Examiner*—Kevin Shaver
*Assistant Examiner*—Melvin A. Cartagena
(74) *Attorney, Agent, or Firm*—Lerner, David, Littenberg, Krumholz & Mentlik, LLP

(57) ABSTRACT

A precompression system for a liquid dispenser prevents liquid from being discharged from the dispenser until a predetermined pressure level has been attained within the dispenser. The liquid dispenser preferably has a liquid inlet and a liquid outlet for discharging the liquid. The precompression system includes a pump chamber having a piston movable in the pump chamber for drawing liquid through the inlet and discharging the liquid through the outlet. The precompression system also includes a valve chamber having a spring valve disposed between the pump chamber and the outlet and being operable to allow liquid in the pump chamber to reach the outlet only after a predetermined pressure is established in the pump chamber and to stop liquid from reaching the outlet when the pressure in the pump chamber falls below the predetermined pressure. The spring valve includes a resilient diaphragm that is normally closed over a valve seat opening in the valve chamber, as well as a peripheral flap extending from the first end of the spring valve for selectively closing the inlet. The valve chamber is in fluid communication with but not in alignment with the pump chamber.

46 Claims, 26 Drawing Sheets

U.S. PATENT DOCUMENTS 5,271,532 A 12/1993 Jumel et al. ..... 222/321
5,297,701 A * 3/1994 Steijns et al. ..... 222/153
5,348,194 A 9/1994 Mascitelli et al. ..... 222/209
5,366,121 A 11/1994 Foster et al. ..... 222/383
5,425,482 A * 6/1995 Foster et al. ..... 222/207
5,471,821 A 12/1995 Lindgren ..... 53/452
5,553,752 A 9/1996 Foster et al. ..... 222/340
5,638,994 A 6/1997 Libit et al. ..... 222/207
5,730,335 A * 3/1998 Mass et al. ..... 222/341
5,759,218 A 6/1998 Martin et al. ..... 55/385
5,788,125 A 8/1998 Steiner et al. ..... 222/331
5,803,318 A 9/1998 Lina ..... 222/321.2
5,839,616 A 11/1998 Irwin et al. ..... 222/321.8
5,845,819 A 12/1998 De Pous ..... 222/321.9
5,875,932 A 3/1999 Meshberg ..... 222/153.13
5,884,845 A 3/1999 Nelson ..... 239/333
5,938,082 A 8/1999 Foster et al. ..... 222/153.09
5,947,341 A 9/1999 Montaner et al. ..... 222/340

* cited by examiner 166
162
174
176
172
56
182
178
180
168
54
164
170
178B
178A
183

PRECOMPRESSION SYSTEM FOR A LIQUID DISPENSER

CROSS REFERENCE TO RELATED APPLICATIONS

The present application claims benefit under 35 U.S.C. Section 119 of Netherlands patent application nos. 1010778 filed Dec. 10, 1998, 1010777 filed Dec. 10, 1998; 1011962 filed May 4, 1999; 1011964 filed May 5, 1999; 1011477 filed Mar. 5, 1999; 1011479 filed Mar. 6, 1999; and 1013139 filed Sep. 24, 1999. The present application also claims benefit under 35 U.S.C. Section 119 of the following U.S. Provisional applications which in turn claimed benefit of one or more of the above-identified Netherlands patent applications: U.S. Provisional application Nos. 60/123,045 for "Precompression System" filed Mar. 5, 1999; 60/124,807 entitled "Precompression System II" filed Mar. 17, 1999; 60/123,222 entitled "Combination of a Sprayer Head and a Fluid Container and the Method of Manufacturing the Sprayer Head and the Fluid Container" filed Mar. 8, 1999; 60/133,339 entitled "Metering Device and Method of Manufacturing Same" filed May 10, 1999; and 60/133,961 entitled "Dosing Device for a Fluid" filed May 13, 1999. The disclosures of U.S. Provisional applications 60/123,045; 60/124,807; 60/123,222; 60/133,339 and 60/133,961 are hereby incorporated by reference herein.

FIELD OF THE INVENTION

The present invention relates to liquid dispensers and more specifically relates to a precompression system for a liquid dispenser whereby liquid in a container is not discharged from the dispenser until a predetermined pressure level is reached.

BACKGROUND OF THE INVENTION

Containers having dispenser assemblies secured thereto are well known. One conventional dispensing system includes a container or bottle having and opening with a removable cap. Typically, the cap is secured over the container opening by screwing the cap onto external threads formed on a neck of a bottle. The screw cap is typically formed as a separate item that is assembled from a number of components. In addition, external threads must be formed on the neck of the bottle. This requires sophisticated molds and molding techniques be used. As a result, conventional liquid dispensers have a large number of parts and assembly of the parts is complex.

Another type of liquid dispenser includes a sprayer bottle having a sprayer housing fixed onto the neck of a container. The sprayer housing generally contains a manually operated pump having a suction side and a compression side. An operating element, such as a trigger, is typically pivotally connected to the pump for operating the pump. A dip tube may extend from the suction side of the pump and into the container so that the liquid in the container may be drawn through the dip tube and into the pump during operation thereof. The trigger sprayer also includes an outlet in fluid communication with the compression side of the pump for discharging the fluid. The trigger sprayer typically includes a spring located in the pump for biasing the piston of the pump to return to a charged position at the end of a discharging pump stroke.

Most trigger sprayers are connected to containers by providing the sprayer with an internally threaded ring and forming external screw threads on the container, preferably at a neck portion of the container. As such, the trigger sprayer is assembled with the container by screwing the trigger sprayer onto the external threads of the container. The need for forming internal and/or external threads adds significant cost to the manufacture and assembly of such dispensers. Manufacturing costs are typically increased because more complicated molding techniques and molds must be used to form threads in the molded components. Assembly costs are increased because sophisticated equipment and/or additional personnel must be used to screw the trigger sprayer onto the external threads of the container.

Thus, the present invention provides a method of making a liquid dispenser that has many advantages over conventional methods. In conventional methods, the container or bottle is typically formed at a first location such as by means of blow molding, and is then fed to a filling line. The bottle typically includes a fixing means such as screw threads provided in the vicinity of the bottle opening or a neck portion thereof. A filling head which is typically assembled at another location is then screwed on to the external threads provided on the neck of the bottle. At the filling line, the bottle is filled and the cap is screwed onto the external threads. This conventional method of filling and assembling bottles requires a relatively large number of operations that are not well integrated with one another so that the assembly process is both time consuming and expensive. In addition, all of the component parts for the final assembly must be formed well before final assembly of the container which results in high inventory costs. Moreover, once the containers have been formed, the empty containers take up a relatively large amount of space during transport to a filling station.

Prior art dispensing devices of the type described above generally have a high number of parts resulting in a product that is both difficult to manufacture and assemble. As a result, both the manufacturing and the assembly of the dispenser parts are expensive and time consuming. This expense and time factor is multiplied by the wide variety of trigger sprayers and containers that are commonly produced. In addition, the various trigger sprayers are often made of different materials, thereby posing problems in handling and recycling the trigger sprayer and the container when the items are ready to be discarded. For example, most, if not all, prior art trigger sprayers employ a metal spring in the pump chamber for returning the trigger to a charged position. As a result, the metal spring must be removed from the trigger sprayer before the plastic portion of the item may be recycled.

Another problem noted with conventional dispensers is that they are ill suited for dispensing consistent doses of fluid each time they are actuated. In response to this problem, commonly assigned U.S. Pat. No. 5,730,335 discloses a precompression system for a dispensing device that prevents liquid from leaving a discharge nozzle of the dispenser at too low a pressure, which would result in insufficient atomization of the liquid with large drops of fluid or liquid being formed in the spray pattern. The precompression system includes a precompression valve moveable between a position that closes off communication between a pump chamber and a discharge nozzle and an open position in which it is spaced from a valve seat for opening communication between the pump chamber and the discharge nozzle. The precompression valve is biased toward a closed position by a spring element. The precompression valve is moved to its open position only when a predetermined pressure is attained within the pump chamber.

One known problem associated with certain precompression systems is that the valve is arranged in line with the pump chamber. Therefore, it is difficult to design this type of precompression system using injection-molding processes. Furthermore, because the valve is in line with the pump chamber of the dispenser housing, the resulting design is relatively bulky, making it difficult to incorporate the precompression feature into compact dispenser housing assemblies and making assembly of such devices complex, costly and time-consuming.

SUMMARY OF THE INVENTION

The present invention relates to various types of liquid dispensers and assembly methods for making such dispensers that overcome the problems described above.

In certain preferred embodiments of the present invention, a liquid dispenser includes a dispenser subassembly having an inlet, an outlet, and a pump in fluid communication with the inlet and the outlet, the pump being movable between a first position and a second position. The liquid dispenser also preferably includes a container having an opening and an actuating element connected thereto. The actuating element is desirably engagable with the dispenser subassembly when the container and the dispenser subassembly are assembled together. In certain preferred embodiments, engagement of the actuating element with the dispenser subassembly is a prerequisite for operating the pump and dispensing the liquid from the dispenser.

The actuating element is preferably connected to the container adjacent the opening of the container, such as being integrally connected to or integrally molded to the container. The container and the actuating element may be made of a polymer, such as a resilient thermoplastic material. The actuating element may include a biasing element, such as one or more flexible springs, engagable with the dispenser subassembly for urging the pump of the subassembly into one of the first and/or second pump positions. In certain embodiments, the container has a longitudinal axis and the biasing element extends in a direction substantially parallel to the longitudinal axis. In these embodiments, the biasing element includes two legs having first ends connected to the container and second ends remote therefrom, the legs having intermediate sections extending away from the opening of the container and the second ends of the legs including a curved portion, such as an inverted U-shaped section. The two legs of the biasing element may be substantially parallel to one another. In still other preferred embodiments, the biasing element extends in a direction substantially perpendicular to the longitudinal axis, such as one or more flexion springs connected to the container.

The container of the present invention preferably has an opening for receiving a liquid, such as a cleaning solution or a high viscosity gel. The container is preferably a thermoplastic preform that is fabricated using injection-molding techniques. The preform may be blow molded into a container having a desired shape immediately before the container in filled with a liquid and assembled with one of the dispenser subassemblies of the present invention. The container desirably includes a shroud extending away from and at least partially surrounding the opening. The shroud is desirably engagable with the dispenser subassembly when the dispenser subassembly and the container are assembled together. The shroud preferably has an inner dimension or shape that substantially coincides with the outer dimension of the dispenser subassembly and/or the housing. The shroud may include an exterior surface having a grippable surface that is sized and shaped to fit a user's hand when a user desires to use the liquid dispenser of the present invention. The shroud preferably includes an interior surface that may surround the biasing element connected to the container and/or the container opening. The interior surface of the shroud, as will be described in more detail below, also includes at least one element that is essential for operating the dispenser subassembly for discharging liquid from the dispenser. As such, either the interior surface or the exterior surface of the shroud, or both, may serve as the actuating element for the dispenser of the present invention. As used herein, the term actuating element means a part that cooperates with or engages the dispenser subassembly for operating the subassembly and the liquid dispenser. The liquid dispenser will generally not operate unless the actuating element engages the dispenser subassembly.

In certain embodiments, the shroud includes a lower end integrally connected with the container adjacent the opening and an upper end remote therefrom. The shroud may also include a front section, a rear section and two side sections extending between the front and the rear. The front of the shroud may be adjacent the biasing element and the rear of the shroud remote therefrom. The sides of the shroud may include one or more slots extending between the interior surface and the exterior surface of the shroud. The slots are sized to receive one or more tabs extending from the housing so that the housing may be snap-fit into the shroud during assembly of the container and the dispenser subassembly.

In highly preferred embodiments, neither the dispenser subassembly nor the container have threads and the dispenser subassembly is not screwed onto the container. As a result, molding techniques for making the component parts may be greatly simplified and there is no need for sophisticated molding devices typically used to form threads in molded parts. This results in a dramatic savings in manufacturing costs. In addition, assembly of the liquid dispenser is simpler because the dispenser subassembly is not screwed onto the container. This greatly reduces assembly costs.

In certain preferred embodiments, the dispenser subassembly includes a housing, preferably made on a thermoplastic material, having the inlet for drawing the liquid into the housing and the outlet for discharging the liquid from the housing. The housing may also have a front, a rear, two lateral sides extending between the front and the rear, an upper end and a lower end. The lower end of the housing generally has a base, such as a circular base, sized and adapted for being secured within the opening of the container. The base may be substantially circular and include an opening for the inlet for liquid into the housing. The housing desirably includes the pump comprising a pump chamber having a first open end facing the front of the housing, a second substantially closed end remote therefrom, and an interior wall extending between the first and second ends thereof. The interior wall has substantially cylindrical shape when viewed in cross-section. The pump also includes a piston movable between the first and the second ends of the pump chamber. The piston may include a piston rod having first and second annular sealing elements adapted for engaging the interior wall of the pump chamber.

The housing of the dispenser subassembly may include one or more peripheral tabs and, as mentioned above, the shroud includes one or more slots sized to receive the tabs so that the dispenser subassembly may be reliably secured to the shroud and the container. The housing may also include a top having a substantially flat upper surface that is adapted for receiving indicia, such as writing or a label indicating the type of liquid and/or product stored in the container. The flat upper is surface of the container preferably comprises the uppermost portion of the container. The flat upper surface may facilitate stacking of multiple containers atop one another during shipping or storage. In other embodiments, the top of the dispenser subassembly lies in substantially the same plane as the upper edge of the shroud.

A movable element or member may be connected to the piston for moving the piston between the first and second ends of the pump chamber, whereby the actuating member engages the movable member when the dispenser subassembly and the container are assembled together for urging the movable member and the piston toward the first pump position. In certain embodiments, the movable member includes a trigger having an upper end, a lower end and a mid-section between the upper and lower ends. The upper end of the trigger may be hingedly connected to the housing while the mid-section of the trigger may be pivotally connected to the piston. The trigger preferably includes an aperture between the mid-section and the upper end thereof, whereby the outlet of the housing, and any nozzle rotatably secured to outlet, may extend through the trigger aperture when the trigger is connected to the housing. The trigger may have a rear surface with one or more channels formed therein for engaging the actuating element during assembly of the liquid dispenser with the container, whereby the actuating element urges the trigger and the piston pivotally connected therewith toward the first pump position. The nozzle may be rotated for changing the shape of a spray discharged from the liquid dispenser and/or for locking the dispenser from dispensing any liquid whatsoever.

In other preferred embodiments of the present invention, a precompression system for a liquid dispenser is operable for allowing liquid entering the inlet to reach the outlet only after a predetermined pressure is established in the pump chamber. The precompression system stops the liquid from reaching the outlet when the pressure in the pump chamber falls below the predetermined pressure. The precompression system preferably includes a valve chamber formed in the housing having a first end facing the rear of the housing, a second end remote therefrom, and an interior wall extending between the first and second ends thereof. The second end of the valve chamber desirably includes an end wall having a valve seat and an is opening extending through the center of the valve seat. The end wall at the second end of the valve chamber also preferably includes at least one relatively small opening therein that extends to the pump chamber for providing fluid communication between the pump chamber and the valve chamber.

The precompression system may include a spring valve having a first end including a flexible diaphragm engagable with the valve seat, a second end remote therefrom and an exterior sleeve extending between the first and second ends. The exterior sleeve of the valve is preferably engagable with the interior wall of the valve chamber. The flexible diaphragm at the first end of the valve preferably includes a convex surface facing the valve seat and a concave surface facing away from the valve seat. The flexible diaphragm, and particularly the convex face thereof, is engagable with the valve seat and normally closes the opening in the valve seat. The diaphragm is preferably in substantial alignment with the outlet of the housing. In embodiments where the container includes a shroud, it is desirable that an interior surface of the shroud engage the dispenser subassembly when the dispenser subassembly and the container are assembled together so that the interior surface of the shroud, and preferably a substantially flat surface connected and/or integrally molded with the shroud, may engage and/or contact the second end of the spring valve for securing the spring valve within the valve chamber. The flat surface in contact with the second end of the valve prevents the spring valve from backing out of the valve chamber during operation of the dispenser. The dispenser would not operate without the inner surface of the shroud engaging the valve.

The housing may include a liquid supply opening between the inlet and the pump chamber that supplies fluid communication there between. In these embodiments, the liquid supply opening extends through the interior wall of the valve chamber and the spring valve includes the exterior sleeve engaging the interior wall of the valve chamber for affecting the flow of the liquid into the pump chamber. The spring valve may include a peripheral flap projecting from the first end of the valve, wherein the peripheral flap covers the liquid supply opening between the liquid inlet and the pump chamber. The peripheral flap may be flexible and incline toward the interior wall of the valve chamber. The peripheral flap preferably seals the liquid supply opening when the piston moves from the first charged position to the second discharged position and opens the liquid supply opening when the piston moves from the second position to the first position. In other words, the peripheral flap is movable away from the liquid supply opening when the piston moves from the second position to the first position so that the liquid may be drawn into the pump chamber and engages the interior wall of the valve chamber during a discharge stroke When the spring valve is seated in the valve chamber, the flexible diaphragm of the spring valve preferably has a convex face in contact with the valve seat and in fluid communication with the pump chamber, whereby the convex face is forced away from the seat valve opening when the pressure within the pump chamber is greater than the combined force of the diaphragm and the ambient pressure cavity. The diaphragm is preferably dome-shaped and may includes a stop member integrally forced with the diaphragm on the concave face or surface thereof. The stop member prevents the diaphragm from flexing too far toward the second end of the valve that the diaphragm becomes invented.

The precompression system of the present invention provides many advantages over conventional liquid dispensers, such as trigger sprayers. With a standard trigger sprayer, as the pressure is building up or decreasing, there will be drips in the pattern that is being sprayed from the trigger sprayer at the beginning of the stroke and near the end of the stroke. When using a precompression valve in accordance with preferred embodiments of the present invention, there is no flow and no drips at the start of the stroke and, when the valve assembly opens, there is a sufficiently high pressure so that there is no immediate spray pattern from the outlet orifice in the nozzle until the pressure in the pumping chamber decreases to a predetermined value where the precompression valve assembly closes and again there is no flow or drips from that point to the end of the stroke of the piston. On release of the trigger and while the piston is moving under the force of the spring to its at rest position during the return stroke of the piston, the valve assembly is closed and there is no flow or drips.

In other embodiments, the liquid dispenser is designed for dispensing specific doses or metered amounts of a liquid, such as a liquid soap or gel. In these embodiments, the housing of the dispenser subassembly includes the pump chamber and a vent chamber adjacent the pump chamber. The liquid dispenser includes a movable element having a first piston and a second piston integrally connected thereto, wherein the first piston has an outer dimension sized for closely engaging an internal wall of the pump chamber and the second piston has an outer dimension sized for closely engaging an internal wall of the vent chamber. The movable element is movable between a first position and a second position, wherein the movable member is closer to the container in the second position than in the first position. The dispenser may also include a locking element cooperating with the movable element for blocking movement of the movable element toward the second pump position. The locking element may include a frangible tongue connected with the liquid outlet and/or a cover for selectively closing the outlet.

During operation, the liquid dispenser of the present invention is preferably in a charged or primed state when the piston is at the first end of the pump chamber and in a discharged or expended state when the piston is at the second end of the pump chamber. When the liquid dispenser is connected to a container, the liquid is preferably drawn into the pump chamber when the piston moves from the second position to the first position and is preferably discharged from the pump chamber when the piston moves from the first position to the second position.

In further preferred embodiments, the pump chamber has a central axis located between the inlet and the outlet. The housing also desirably includes a valve chamber between the pump chamber and the outlet, whereby the valve chamber has a central axis and is in fluid communication with the pump chamber. Although the central axes of the pump chamber and the valve chamber are substantially parallel to one another, the two chambers are not in linear alignment with one another. In other words, the central axis of the pump chamber is offset from the central axis of the valve chamber.

In still other preferred embodiments, a liquid dispenser includes a dispenser subassembly and a container subassembly assembled therewith, whereby the container subassembly includes integral therewith a portion of the housing of the dispenser subassembly. In other words, the container subassembly is adapted to cooperate with and form at least a portion of the housing for the dispenser subassembly when the dispenser subassembly and container subassembly are assembled together. In these embodiments, the actuating element may be connected with the dispenser subassembly before the dispenser subassembly and the container are connected together. As a result, the actuating element is not preassembled with the container before the dispenser subassembly and the container are assembled together. However, in other preferred embodiments, the actuating element may be connected to the container so that the actuating element is engagable with the dispenser subassembly when the container subassembly and the dispenser subassembly are in their assembled configuration.

The present invention also includes a method of priming or charging a liquid dispenser during final assembly thereof including providing a dispenser subassembly having an inlet, an outlet, and a pump in fluid communication with the inlet and the outlet, the pump being movable between a first position and a second position, and then providing a container having an opening for receiving a liquid and an actuating element connected thereto, the actuating clement being engagable with the dispenser subassembly when the dispenser subassembly and the container are assembled together. The pump of the dispenser subassembly is then positioned in the second position. The container may then be formed, filled with a liquid and assembled with the dispenser subassembly. During the final assembling step, the actuating element connected to the container engages the dispenser subassembly for moving the pump into the first pump position so as to draw the liquid into the pump. The dispenser subassembly preferably includes a movable element in contact with the pump for moving the pump between the first and second pump positions, wherein the actuating element engages the movable element during the assembly step for moving the pump from the second pump position to the first pump position.

DETAILED DESCRIPTION OF PREFERRED EMBODIMENTS

Figure 1:
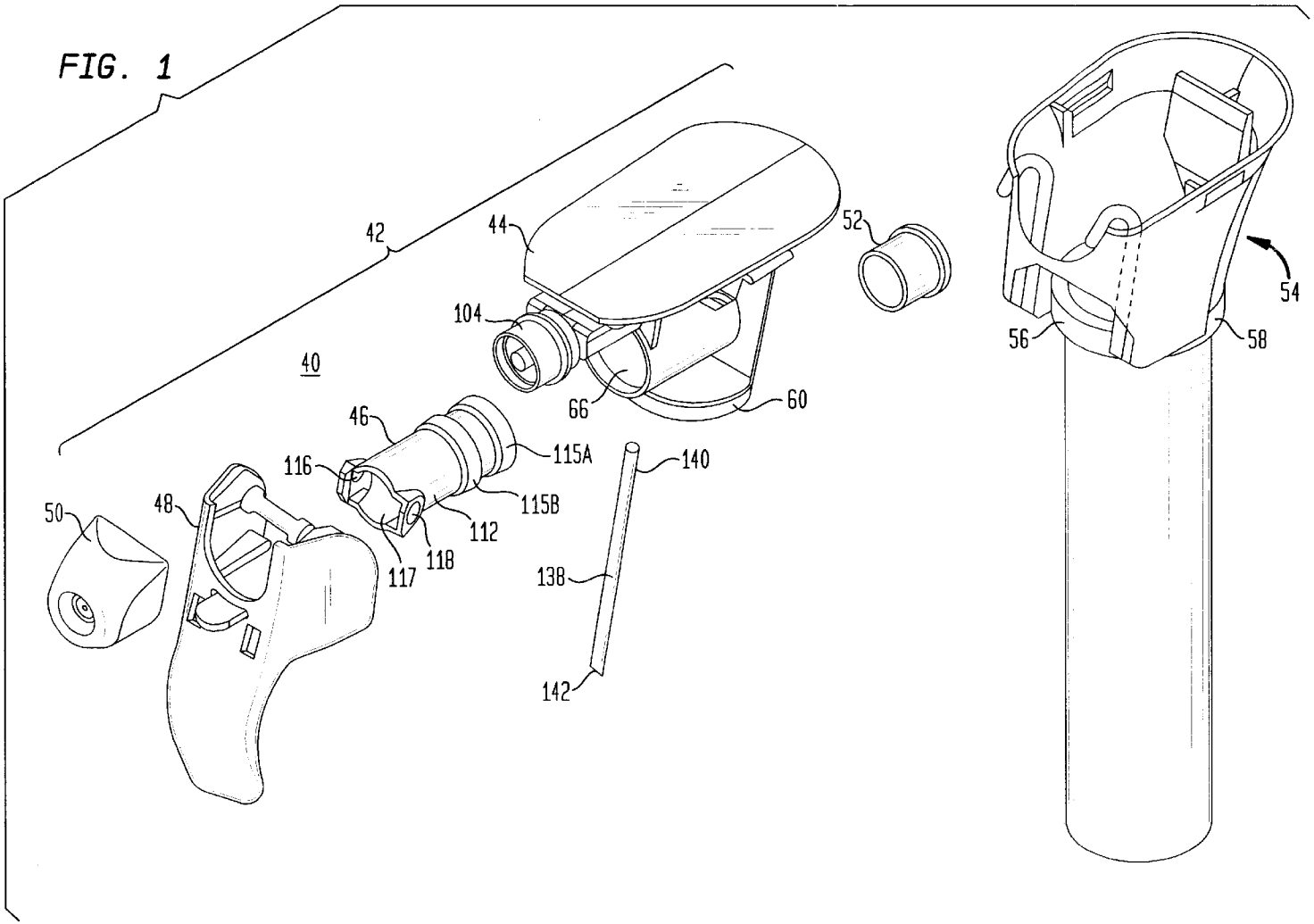
FIG. 1 shows an exploded view of a liquid dispenser including a container and a dispenser subassembly having a housing, a piston, a trigger, a nozzle and a valve in accordance with certain preferred embodiments of the present invention.

FIG. 1 shows an exploded view of a liquid dispenser 40 in accordance with one preferred embodiment of the present invention. The liquid dispenser 40 includes a dispenser subassembly 42 including housing 44, a piston 46, a trigger mechanism 48, a discharge nozzle 50 and a valve 52. The liquid dispenser 40 also includes a container 54 having an opening 56 at an upper end 58 thereof for at least partially securing the dispenser subassembly 42 therein.

Figure 2A:
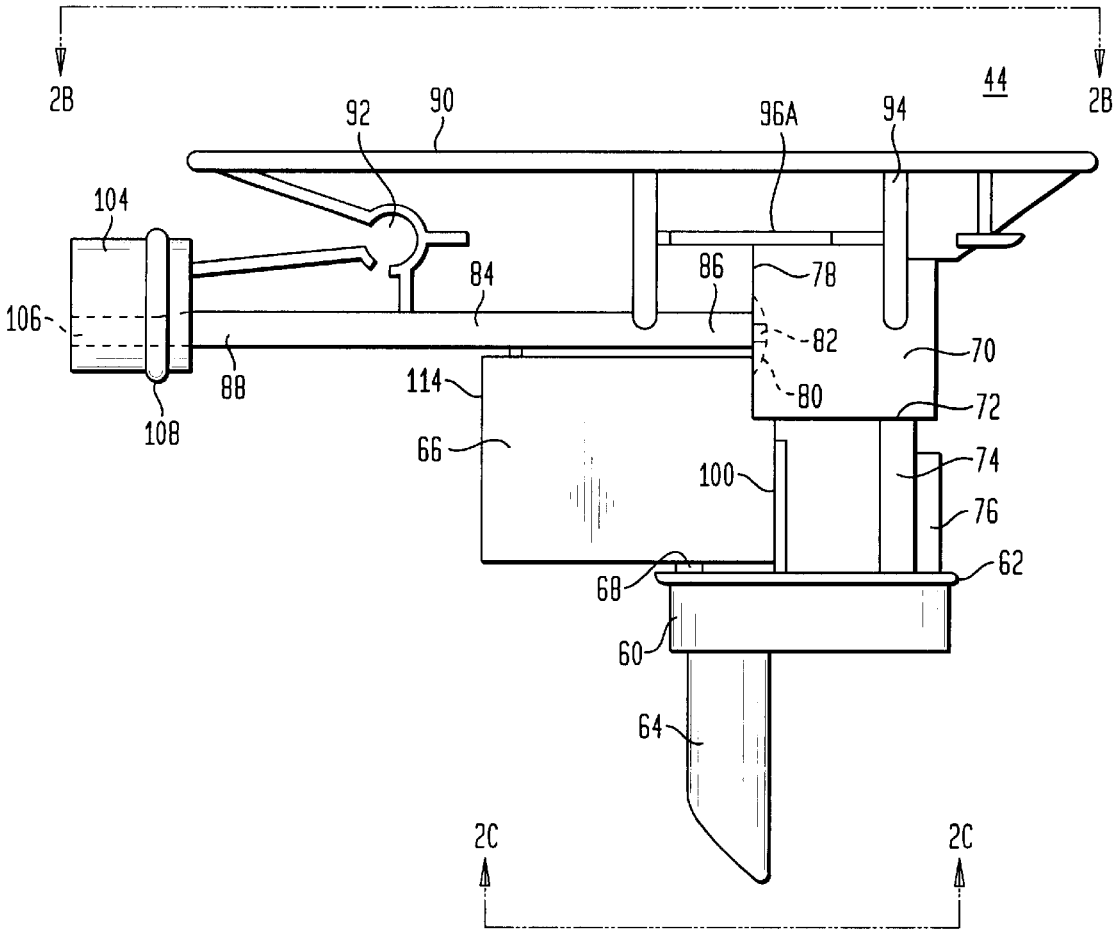
FIG. 2A shows a side view of the housing of FIG. 1 including a pump chamber and a valve chamber.

Referring to FIGS. 1 and 2A, the housing 44 of the dispenser subassembly includes a circular base 60 sized to fit within the opening 56 of the container 54. The circular base 60 includes an annular flange 62 at an upper end thereof for creating a fluid-tight seat between the circular base 60 and the container opening 56. The housing 44 also include two alignment legs 64 projecting from an underside of the circular base 60. The two alignment legs 64 guide the movement of the housing 44 into the opening 56 of the container 54 during an assembly process, as will be described in more detail below.

Referring to FIGS. 1 and 2A, the housing 44 includes a pump comprising a pump chamber 66 in fluid communication with the underside of the is circular base 60 via an aeration orifice 68 extending between the pump chamber 66 and the circular base 60. As will be described in more detail below, after the dispenser subassembly has been attached to the container the aeration orifice prevents a vacuum from developing within the container during operation of the liquid dispenser. The housing also includes a valve chamber 70 having an internal wall with a substantially cylindrical shape. The valve chamber 70 has a liquid supply opening 72 at a bottom section of the internal wall that is in alignment with a liquid supply passage 74 extending between the valve chamber 70 and the underside of the circular base 60. The liquid supply passage 74 includes a supporting flange 76 connected to the upper surface of the circular base 60 for adding rigidity to the liquid supply passage 74 and for guiding the housing 44 into the opening 56 of the container during assembly. The valve chamber 70 includes an end wall 78 having a valve seat 80 with an opening 82 in the center thereof. The valve seat opening 82 is in fluid communication with a discharge conduit 84 having a first end 86 adjacent the valve chamber 70 and a second end 88 remote therefrom.

Figure 2B:
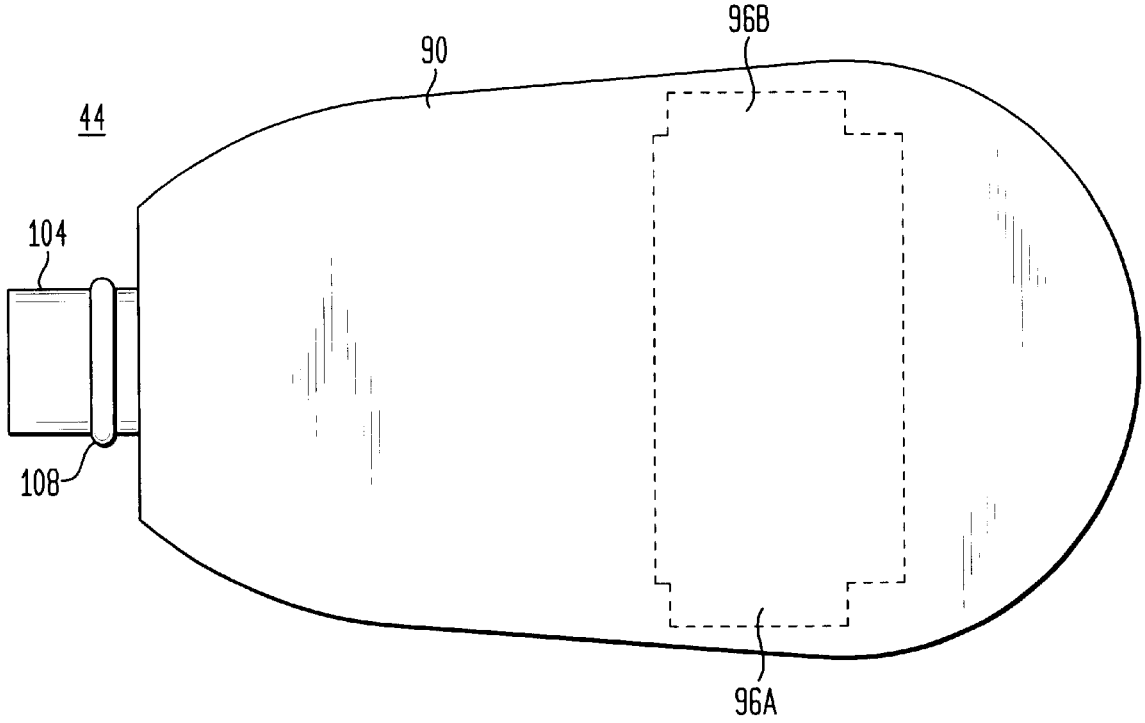
FIG. 2B shows a top view of the housing of FIG. 2A taken along line IIB—IIB of FIG. 2A.

Referring to FIGS. 2A and 2B, the housing 44 also has a substantially flat top surface 90 extending along the longitudinal axis thereof. The substantially flat surface preferably includes an indicia-bearing section so that a label, or other indicia, indicating the type of liquid/product stored in a container, may be placed on the flat surface. The front end of the housing also includes a flexible opening for securing a portion of an operating element, such as a trigger, as will be described in more detail below. The housing 44 has a lateral support 94 including lateral tabs 96A and 96B which arc provided for connecting the housing the container, as will be described in more detail below.

Figure 2C:
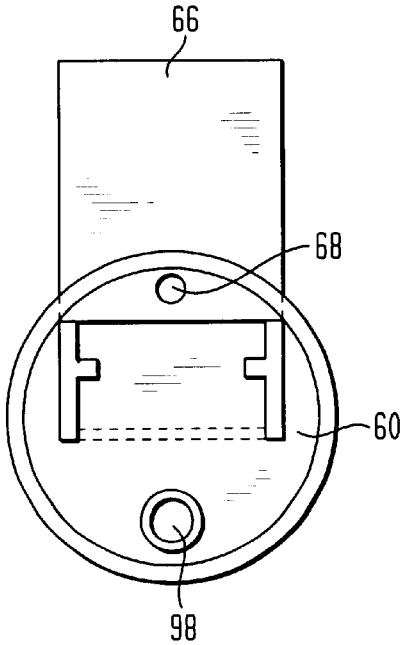
FIG. 2C shows a bottom view of the housing of FIG. 2A taken along line IIC—IIC of FIG. 2A.

FIG. 2C shows a bottom view of the housing 44. The underside of the circular member 60 includes aeration orifice 68 in communication with pump chamber 66 and opening 98 in communication with liquid supply passage 74 (FIG. 2A) for providing fluid communication between the underside of circular member 60 and valve chamber 70.

Figure 3A:
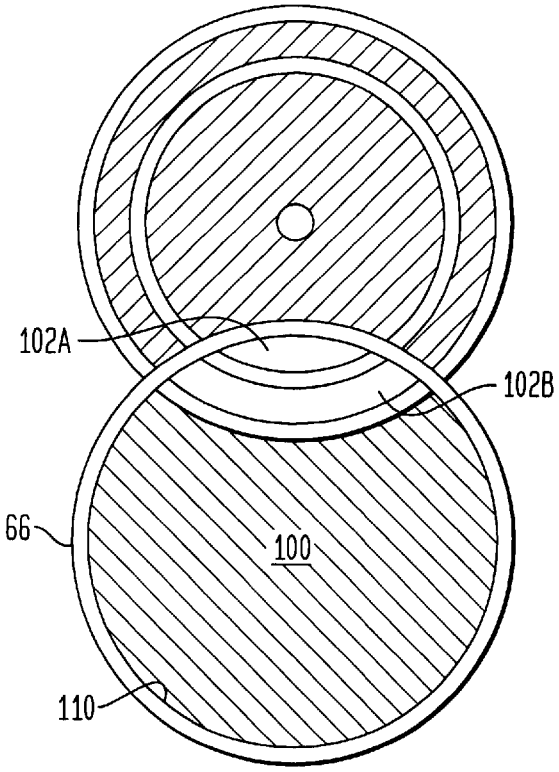
FIG. 3A shows a simplified front view of the pump chamber and the valve chamber of FIG. 2A.
Figure 3B:
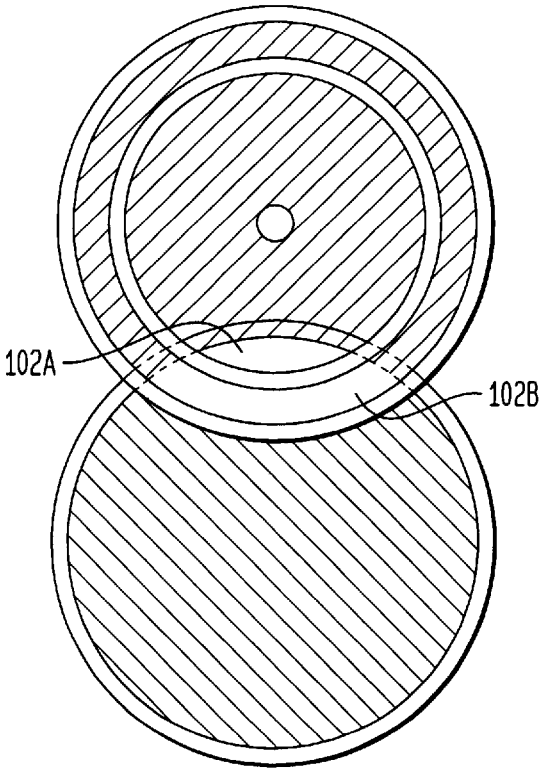
FIG. 3B shows a simplified rear view of the valve chamber and the ump chamber of FIG. 2A.
Figure 4A:
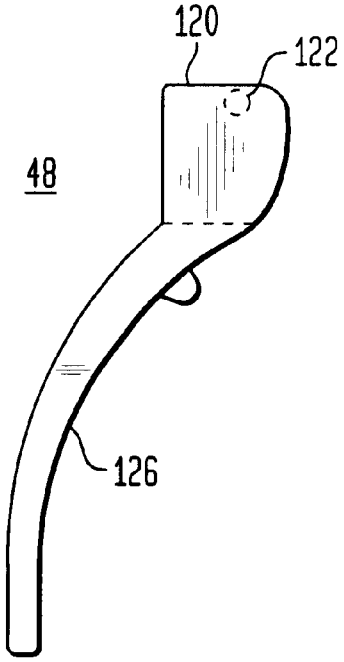
FIG. 4A shows a side view of the trigger shown in FIG. 1.
Figure 4B:
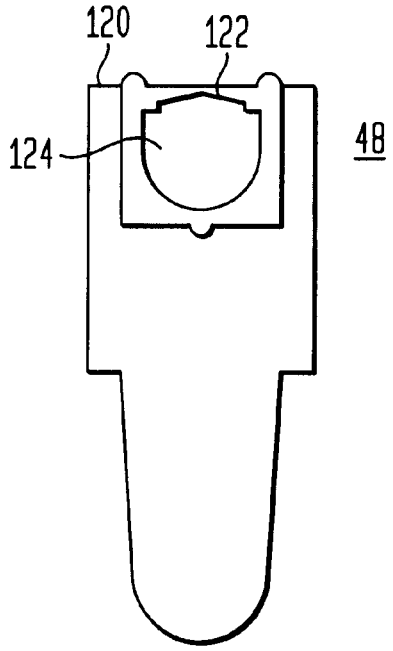
FIG. 4B shows a front view of the trigger shown in FIG. 4A.
Figure 4C:
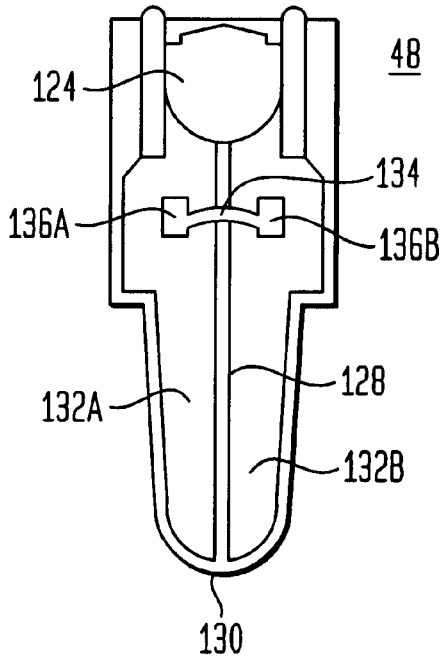
FIG. 4C shows a rear view of the trigger shown in FIGS. 4A and 4B.

FIGS. 3A and 3B show simplified views of the pump chamber 66 and the valve chamber 70. FIG. 3A is a simplified front view of the housing 44 and shows the pump chamber 66 including rear wall 100 having two small openings 102A and 102B at the upper end of rear wall 100 for providing fluid communication between the pump chamber 66 and the valve chamber 70. FIG. 3B shows a rear view of the housing 44 including valve chamber 70 having rear wall 78 including openings 102A and 102B for providing fluid communication with the pump chamber 66. The pump chamber 66 includes a longitudinal axis extending in a direction substantially parallel to the discharge conduit 84. The valve chamber 70 also includes a longitudinal axis extending in a direction substantially parallel to the discharge conduit 84. However, the pump chamber 66 and the valve chamber 70 arc not in alignment with one another as is the case with conventional fluid or liquid dispensers having a pump chamber in communication with a valve chamber. As a result, the housing may be manufactured using simplified injection molding techniques.

Referring to FIGS. 2A and 2B, the housing 44 also includes a discharge outlet 104 connected to the second end 88 of the discharge conduit 84 and having an opening 106 in fluid communication therewith. The discharge outlet 104 includes an annular ring or flange 108 extending around the outer surface thereof. Referring to FIGS. 1 and 2A, a discharge nozzle 50 may be secured to the outer surface of the discharge outlet 104. The discharge nozzle 50 includes a resilient material, such as plastic, and preferably includes an annular depression (not shown) sized to snap fit over the annular ring 108 on the exterior surface of the discharge outlet 104. After being assembled thereto, the discharge nozzle 50 may be rotated into various positions for modifying the type of liquid spray discharged from the liquid dispenser.

Referring to FIGS. 1 and 3A, the housing 44 includes the pump chamber 66 having rear end wall 100 and an internal wall 110 with a substantially cylindrical shape when viewed in cross section. The substantially cylindrically is shaped internal wall is sized for receiving the piston 46 including a piston rod and first and second annular piston flanges 115A and 115B. The piston 46 is adapted for reciprocating movement between a first end 114 and the rear wall 100 of the pump chamber 66. As mentioned above, the rear wall 100 of the pump chamber 66 closes off the pump chamber 66 from the valve chamber 70 except for the two small openings 102A and 102B providing fluid communication between the pump chamber and the valve chamber 70.

The piston 46 also includes a central bore 117 formed at the first end thereof and two lateral projections 116 having apertures 118 for facilitating a connection with the trigger 48, as will be described in more detail below.

Referring to FIGS. 1 and 4A–4C, the dispenser subassembly 42 includes an operating element, such as trigger 48. The trigger 48 includes an upper end 120 having a pivotable shaft 122 that may be received within the flexible opening 92 at the front end of the housing. The trigger 48 also includes an aperture 124 extending therethrough so that the discharge outlet 104 may fit through the aperture 124 when the trigger 48 is connected to the housing 44, Referring to FIG. 4C, the rear side 126 of the trigger 48 includes a support rib 128 extending between the lower end 130 of the trigger 48 and the annular opening 124. The support rib 128 defines two channels 132A and 132B extending between the lower end 130 and the trigger aperture 124. The trigger 48 also includes a lateral support 134 including protruding cams 136A and 136B that are sized to fit within the openings 118 at the first end of the piston 46.

Referring to FIGS. 1, 2A and 2C, the liquid dispenser 40 includes a dip tube 138 having a first end 140 secured to the liquid supply passage 74 extending to the valve chamber 70. The first end 140 of the dip tube 138 is preferably inserted into the opening 98 at the underside of the circular base 60 of the housing (FIG. 2C). The dip tube 138 has a second end 142 that preferably extends into the container 54 after the dispenser subassembly 42 has been assembled with the container. The dip tube 138 draws the liquid stored in the container 54 into the liquid supply passage 74 is and ultimately into the pump chamber 66.

Figure 5A:
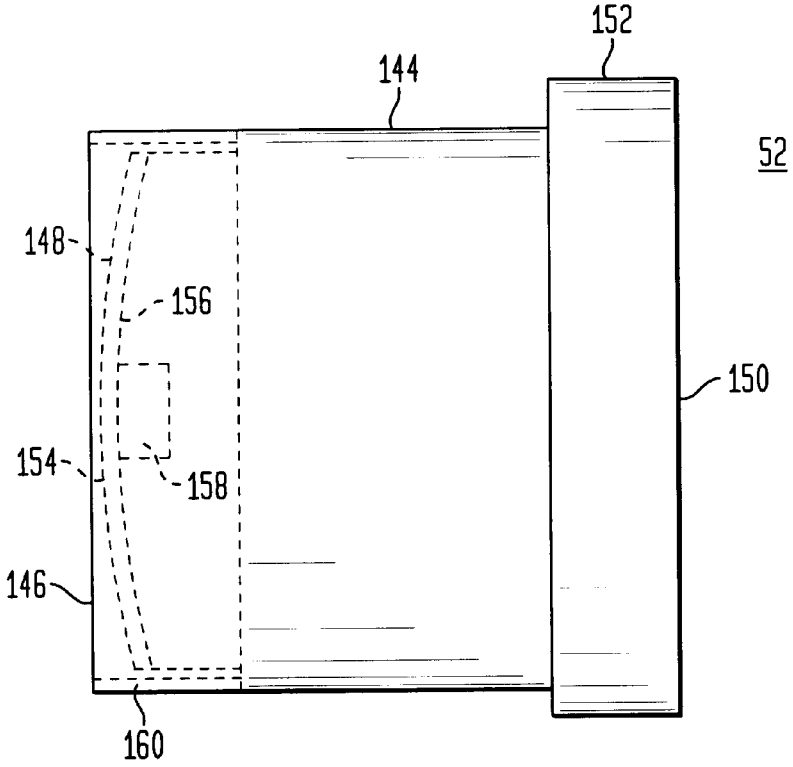
FIG. 5A shows a side view of the valve shown in FIG. 1.
Figure 5B:
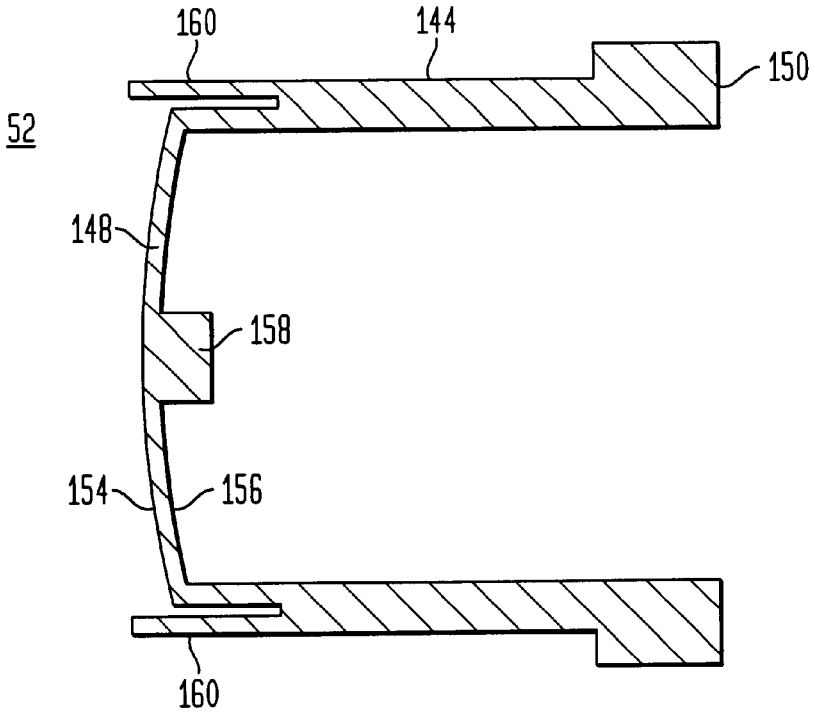
FIG. 5B shows a cross-sectional view of the valve shown in FIG. 5A.

Referring to FIGS. 1, 5A and 5B, the valve chamber 70 has a valve 52 secured therein. The valve 52 includes an exterior sleeve 144 having a cylindrical shape, the exterior sleeve 144 being sized to fit snugly within the cylindrical-shaped internal wall of the valve chamber 70. The valve has a first end 146 including a flexible diaphragm 148 and a second end 150 remote therefrom. Adjacent the second end 150 thereof, the valve 144 has an outer surface 152 having a diameter that is larger than the diameter of exterior sleeve 144. The diameter of outer surface 152 is also greater than the internal diameter of valve chamber 70 for halting movement of the valve 52 toward the rear wall 78 of the valve chamber 70 once the valve is properly seated in the valve chamber. The diaphragm 148 at the first end 146 of the valve has a substantially convex-shaped exterior surface 154 and a substantially concave-shaped interior surface 156. The interior surface 156 of the diaphragm 148 also has a stop member 158 integrally molded therewith for limiting the flexibility of the diaphragm 148 toward the second end 150 of the valve. The valve 52 also includes a peripheral flap 160 that projects from the first end 146 of the valve. The peripheral flap 160 extends completely around the outer periphery of the valve 52 and is flexible, as will be described in more detail below.

Referring to FIGS. 1 and 6A–6C, after the dispenser subassembly 42 has been assembled, it is adapted for being secured at least partially within the container 54. As used herein, the term container may mean a container that is a preform (having a shape similar to that of a test tube) or that has been blow molded into a desired shape. The container 54 includes an upper end 162 and a lower end 164 remote therefrom. The container has an opening 56 at the upper end 162 thereof. The opening 56 may be reinforced by circular ring 164 integrally molded and/or attached to the upper end 162 of the container 54. The container includes a shroud 166 extending from the upper end 162 of the container 54 and at least partially surrounding the opening 56. The shroud 166 includes a front end 168 having a depression 170 for allowing the discharge outlet 104 to extend therethrough. The shroud 166 also includes slots 172 formed on the sides thereof that are sized for receiving the lateral projections 96A and B extending from the housing 44 so that the housing may be secured (e.g., snap-fit) to the shroud 166. The shroud also includes a rear wall 174 having a substantially flat surface 176. The rear wall 174 is in substantial alignment with a peripheral edge of the opening 56 so that the rear wall 176 will closely engage the second end 150 of the valve 52 when the dispenser subassembly 42 is secured to the container 54. Thus the rear wall 174 of the shroud 166 locks and/or reliably secures the valve 52 within the valve chamber 70 and provides for an ambient pressure chamber between the concave face 156 of the valve and the rear wall 174.

Figures 6A, 6B, 6C:
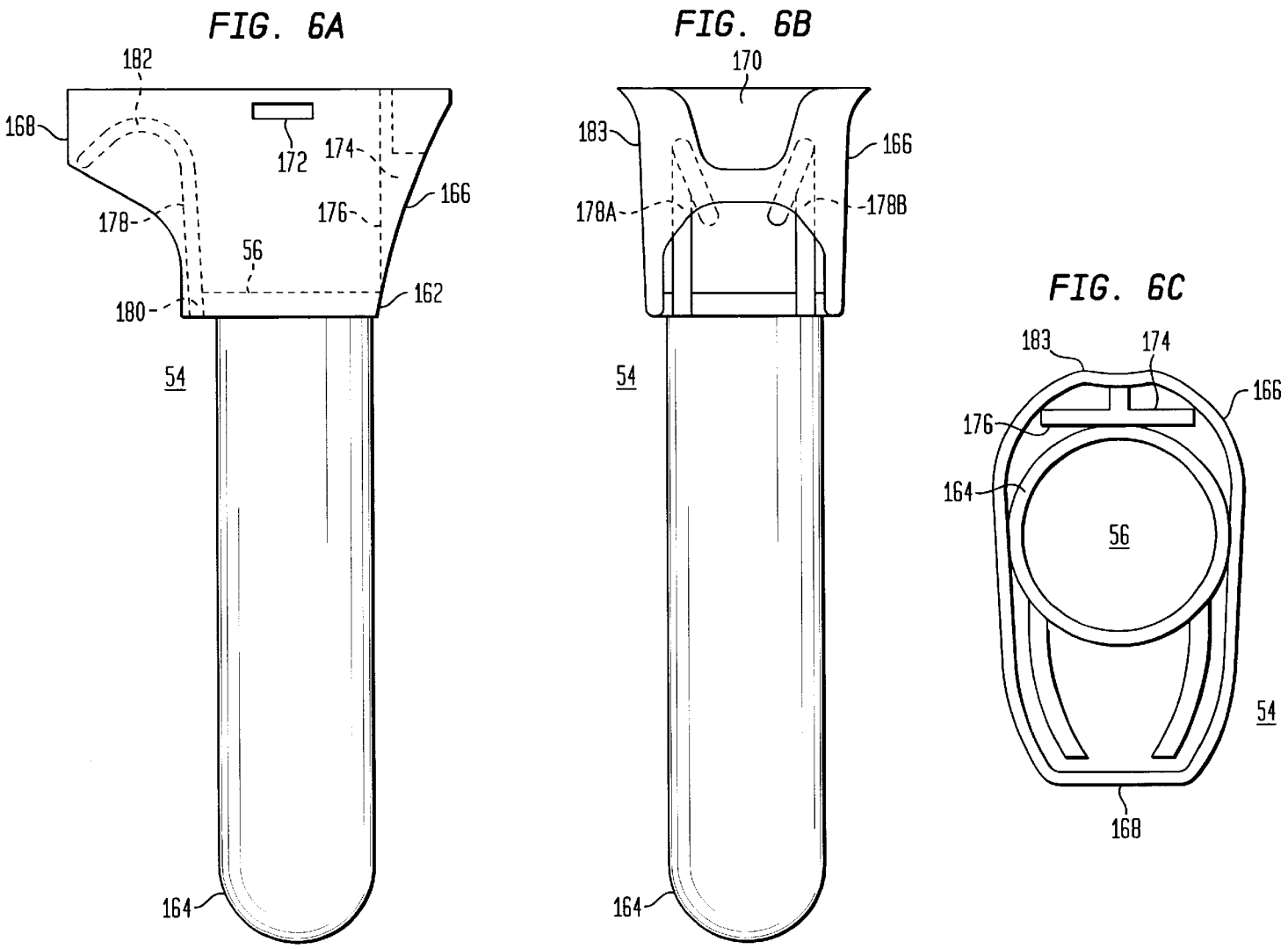
FIG. 6A shows a side view of the container shown FIG. 1.
FIG. 6B shows a front view of the container shown in FIG. 6A.
FIG. 6C shows a top view of the container shown in FIGS. 6A and 6B.

Referring to FIGS. 6A–6C, the container 54 also includes at least one operating element connected thereto for operating the dispenser subassembly. In this preferred embodiment the container 54 includes a biasing element connected to the container adjacent the opening 56. The biasing element preferably includes two flexible arms 178A and 178B having lower ends 180 integrally connected to the container 54 and upper ends 182 extending away from the container. The flexible arms 78 include inverted U-shaped sections at the upper ends 182 thereof that extend toward the front end 168 of the shroud 166 The front end of the shroud also includes an aperture 170 for allowing the trigger assembly to pass therethrough when the subassembly 42 is secured to the container 56. After assembly, the inverted U-shaped portion 182 of the biasing element 178 engages the channels 132A and 132B (FIG. 4C) on the rear side of the trigger 48 for urging the trigger into an extended or charged position, as will be described in more detail below. The operating/element may also include the outer surface 183 of the shroud that can serve as a grip for securing the liquid dispenser.

Referring to FIGS. 1–6C, in one preferred assembly method, the dispenser subassembly 42 is first assembled and the dispenser subassembly is then secured to container 54.

The dispenser subassembly is assembled by first inserting the upper end 140 of the dip tube 138 into the opening 98 in the underside of the circular member 60. The valve 52 is then connected to the housing 44 by inserting the first end of the valve 52 into the valve chamber 70 until the larger outer surface 152 at the second end 150 of the valve 52 engages the outer edge of the valve chamber 70. The piston 46 is then inserted into the pump chamber 66 so that the central bore 115 and the lateral openings 118 of the piston 46 extend from the outer end 114 of the pump chamber. The trigger 48 is then connected to the housing 44 by snapping the shaft 122 at the upper end 120 of the trigger 48 into the opening 92 at the front end of the housing 44 so that the trigger 48 is hingedly connected with the housing. The trigger is then operatively connected to the piston 48 by snapping the protruding cams 136A and 136B at the rear 126 of the trigger 48 into the lateral openings 118 of the piston 46. After the trigger has been completely connected, the discharge outlet projects through the aperture 124 extending through the trigger 48. The nozzle 50 is then attached to the discharge outlet 104 at the second end 88 of the discharge conduit 84.

Figure 7:
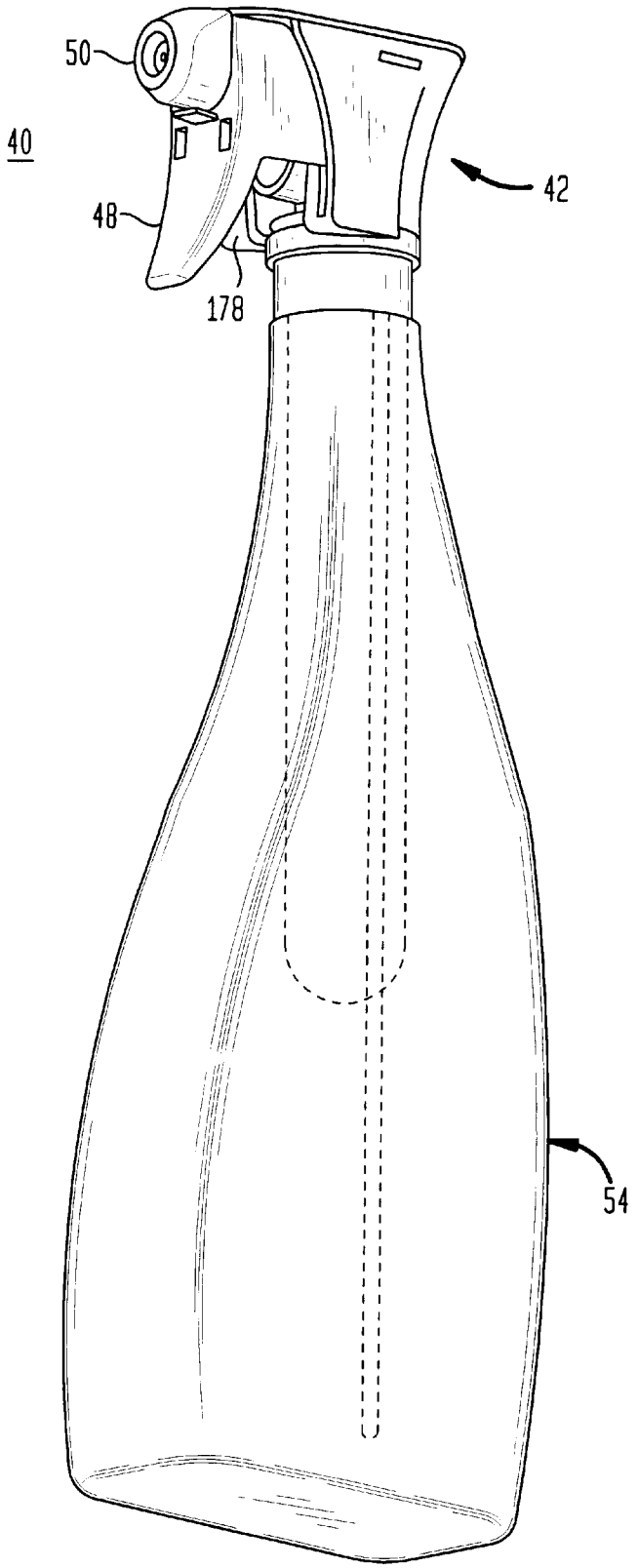
FIG. 7 shows the liquid dispenser of FIG. 1 after the dispenser subassembly has been assembled with the container 7.

The completely assembled dispenser subassembly 42 may then connected to the container 54 by inserting the subassembly into the shroud until the circular member 60 fits snuggly within the container opening 56. The insertion of the dispenser subassembly 42 into the container 54 is limited by the annular flange 62 of the circular base 60 contacting the periphery of the container opening 56. The upper end of the subassembly 42 is secured to the shroud 166 by inserting the tabs 96 at the sides of the housing into the slots 172 of the shroud. After the tabs have been fully inserted into the slots, the substantially flat top surface 90 of the housing 44 lies directly above the upper edge of the shroud and lies in a plane parallel to the upper edge of the shroud. The completely assembled liquid dispenser is shown in FIG. 7.

Figure 8A:
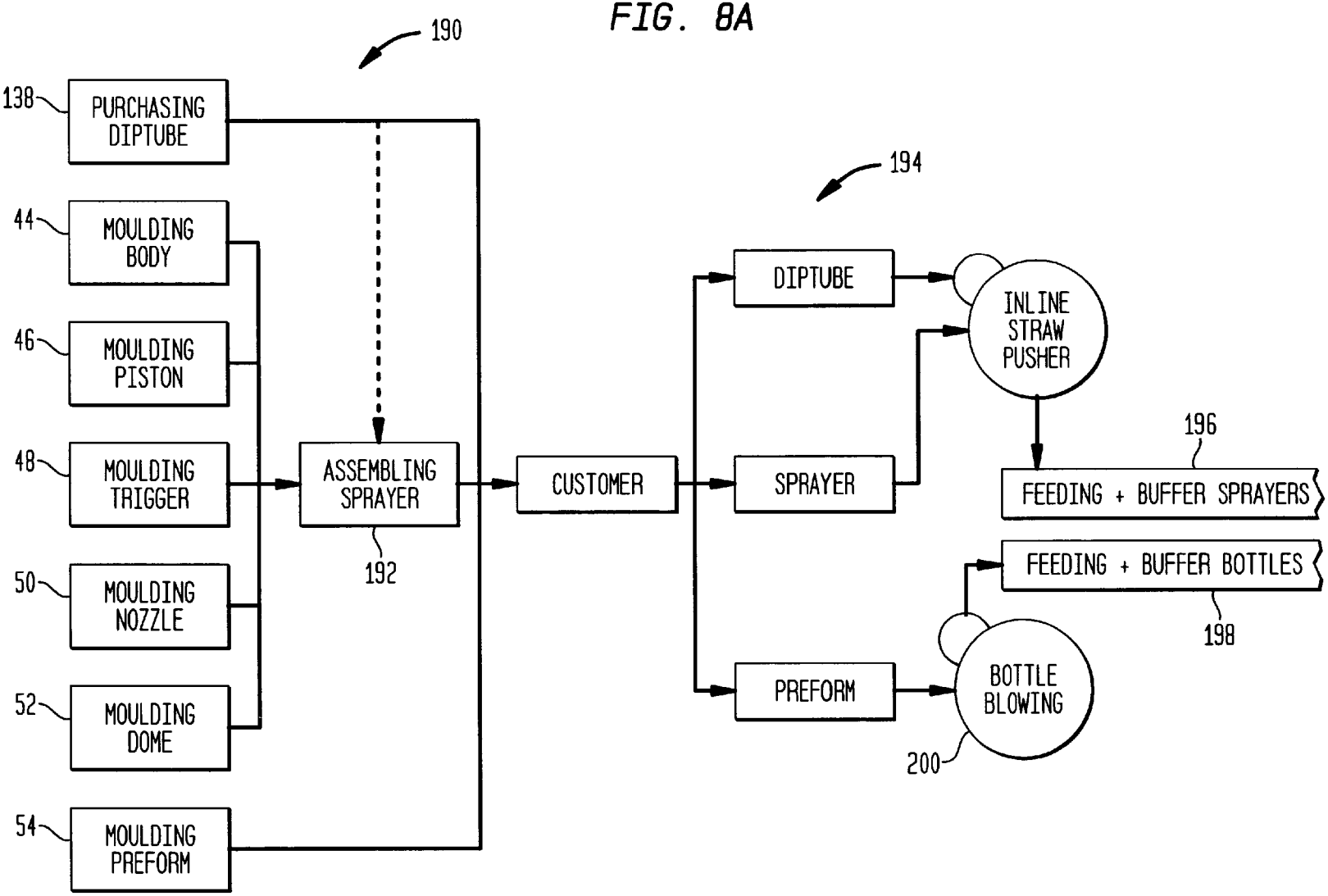
FIG. 8 is a schematic drawing showing one method of assembling the liquid dispenser shown in FIG. 1, in accordance with certain preferred embodiments of the present invention.
Figure 8B:
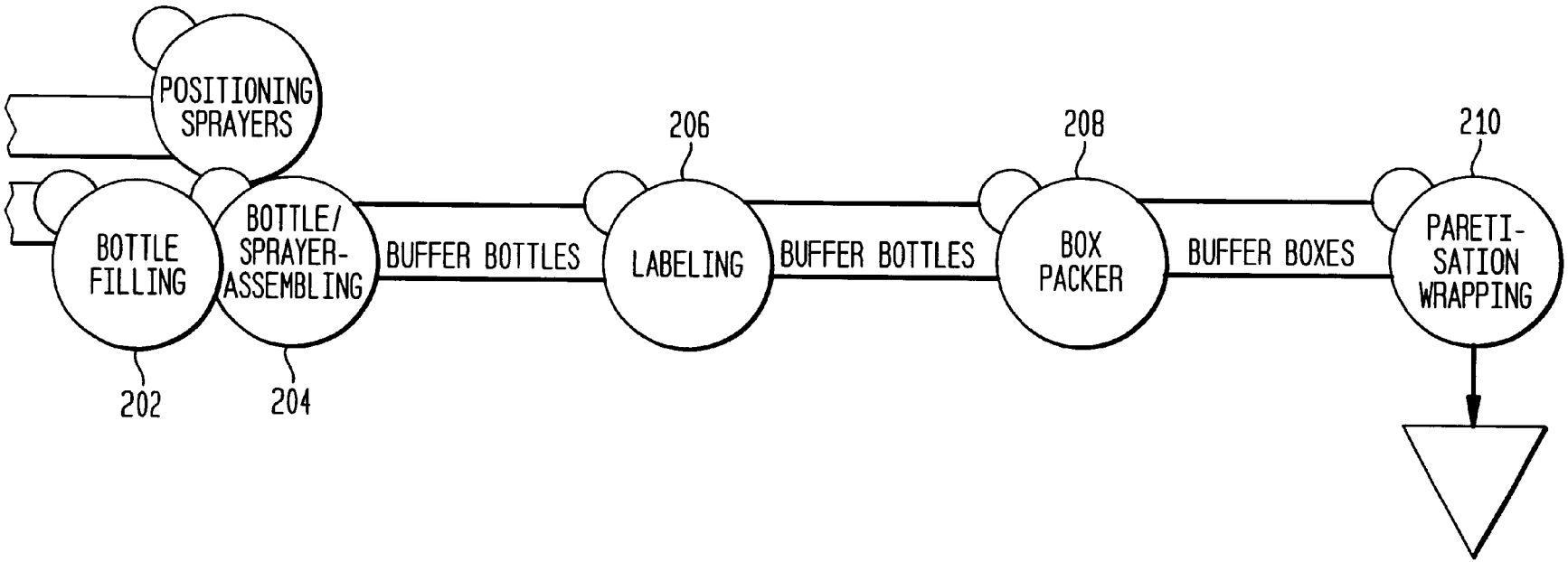

FIG. 8 is a schematic diagram showing one preferred method for forming, assembling and filling the liquid dispenser of the present invention. At a first location 90, the housing 44 including the circular base 60, the pump chamber 66, to the valve chamber 70, the liquid supply passage 74, the discharge conduit 84 and the discharge outlet 104 is injection molded in one step. In addition, the trigger 48, the piston 46, the valve 52, the nozzle 50 and the dip tube 138 are formed by any suitable technique, such as injection molding. All of these component parts are assembled together at step 192.

At either the same location or a different location, the container 54 is formed. The container 54 preferably has an operating element of the liquid dispenser connected to or integrated therewith. In the embodiments described above, the operating element integrated with the container 54 is the biasing element 178 and the shroud 166. In other preferred embodiments, the integrated operating element may be either the biasing element 178 alone, without the shroud, or the shroud 166 alone, without the biasing element. The container 54 is preferably first molded as a relatively thick-walled preform having a shape that is substantially similar to that of a test tube. The size of the test-tube shaped preform is substantially smaller than the size of the final container after the preform has been blow molded into a desired shape. The preform container 54 is then shipped to a liquid filling and assembly point before it is blow molded into a larger container. As a result, the cost of transporting and storing the preform before final assembly is substantially reduced. The various parts of the liquid dispenser, including the preform and the dispenser subassembly are then transported at step 194 to a final assembly location, where the preforms are blow molded into a container having a desired shape, filled with a liquid product, and assembled with the dispenser subassemblies.

At the final assembly station, the dispenser subassembly is moved to a positioning station via a buffer 196. The test-tube like preform 54 with its integrated biasing element and shroud is supplied to a filling line via buffer 198. At a first station 200, the test-tube like preform 54 is heated and blow molded into a container having the desired final shape. The preform is preferably provided with a handling edge so that the preform may be secured by a mechanical processing element. After the container is blow molded at the blow molding station 200, the formed container is filled with a liquid, such as a liquid detergent, at filling station 202. Finally, the filled container is closed at assembling station 204 by securing the dispenser subassembly to the container. The liquid dispenser is then labeled at station 206, packed in boxes at station 208, and palletized and wrapped at station 210.

Because the container includes an element for operating the liquid dispenser (i.e., discharging a liquid stored therein), final assembly and charging of the liquid dispenser takes place at the moment that the container 54 is filled with a liquid and the dispenser subassembly has been secured to the container at station 204. As a result, the total number of steps that must be performed to assemble the liquid dispenser of the present invention is much lower than the number of steps required for conventional trigger sprayers having dispensing housings that must be completely preassembled before being connected to a liquid container.

In the preferred embodiment shown in FIGS. 1–8, the assembled liquid dispenser 40 includes a precompression system that prevents liquid from being discharged through the discharge nozzle until a predetermined pressure level has been attained within the pump chamber. Discharging liquid from the discharge nozzle 50 at an insufficient pressure level is highly undesirable and will result in the liquid being insufficiently atomized, whereby drops generated in the spray pattern will be too large. In order to prevent this from occurring, the present invention provides a precompression system between the liquid container 54 and the discharge nozzle 50 that includes a normally closed valve 52 that normally closes the opening 82 in the valve seat at the upstream end 86 of the discharge conduit 84. The diaphragm is normally closed over the valve seat due to its domed configuration and assisted by the ambient pressure chamber between the concave face of the diaphragm and the substantially flat end wall of the shroud. The diaphragm moves away from the opening in the valve seat 80 only when sufficient pressure, for instance on the order of three bar, is built up in the pump chamber 66 when the piston 46 moves toward the rear wall 100 of the pump chamber 66. Moreover, unlike conventional precompression systems, the precompression system of the present invention does not require the pump chamber and the valve chamber to be in alignment with one another. This is because the valve 52 and the ambient pressure chamber behind the concave face of the valve 52 provides the spring force that must be overcome in order to open the valve. This provides a dramatic improvement over prior art precompression systems requiring the use of metal springs and alignment between is the pump chamber and the valve chamber. Since the pump and the valve chambers of the present invention do not have to be in alignment, the dispenser subassembly may be produced using a one step injection molding step, rather than the multiple step process required when making prior art precompression systems.

Figure 9:
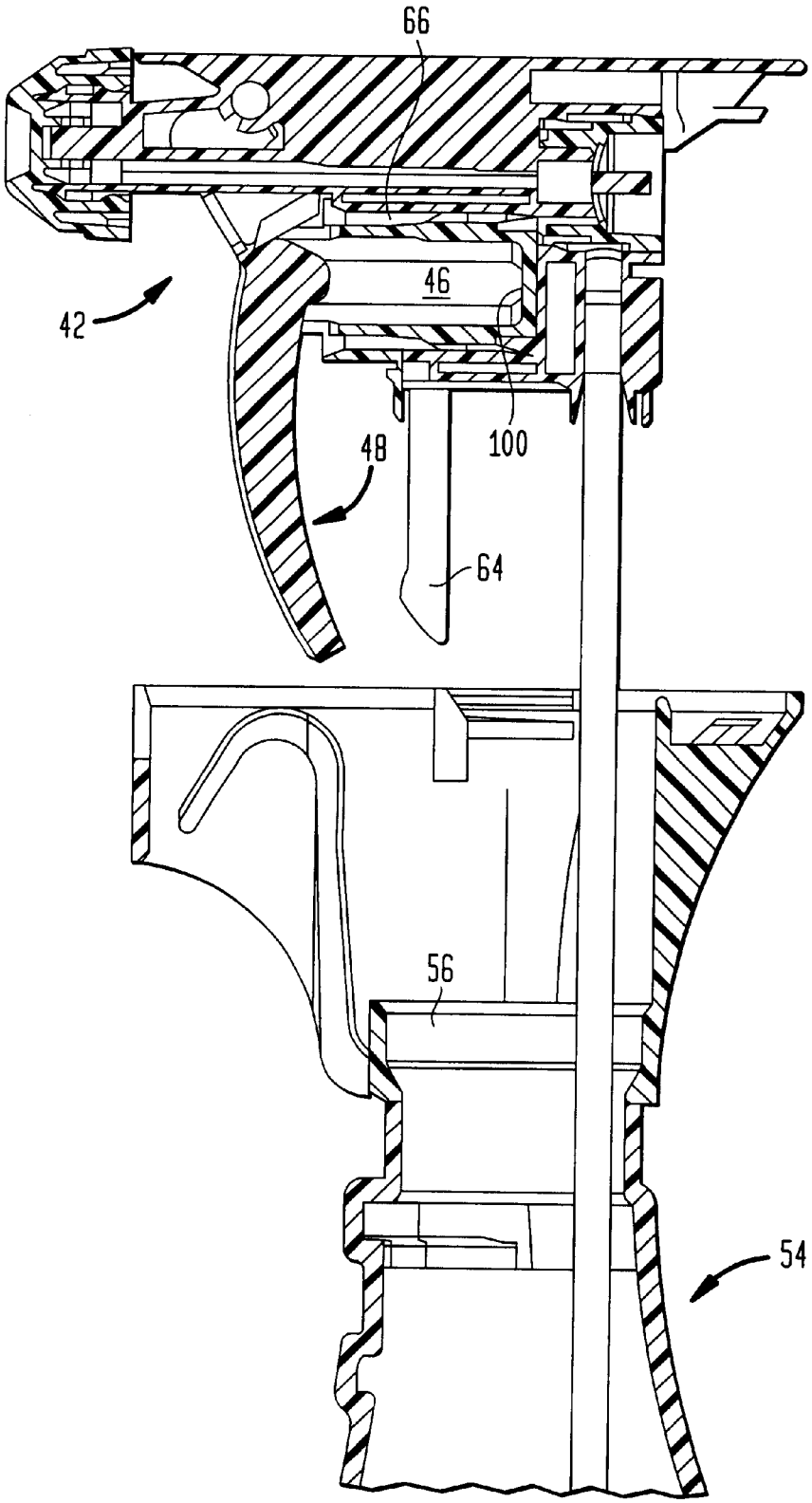
FIG. 9 shows a first step for assembling a dispenser subassembly with a container, in accordance with certain preferred embodiments of the present invention.
Figure 10:
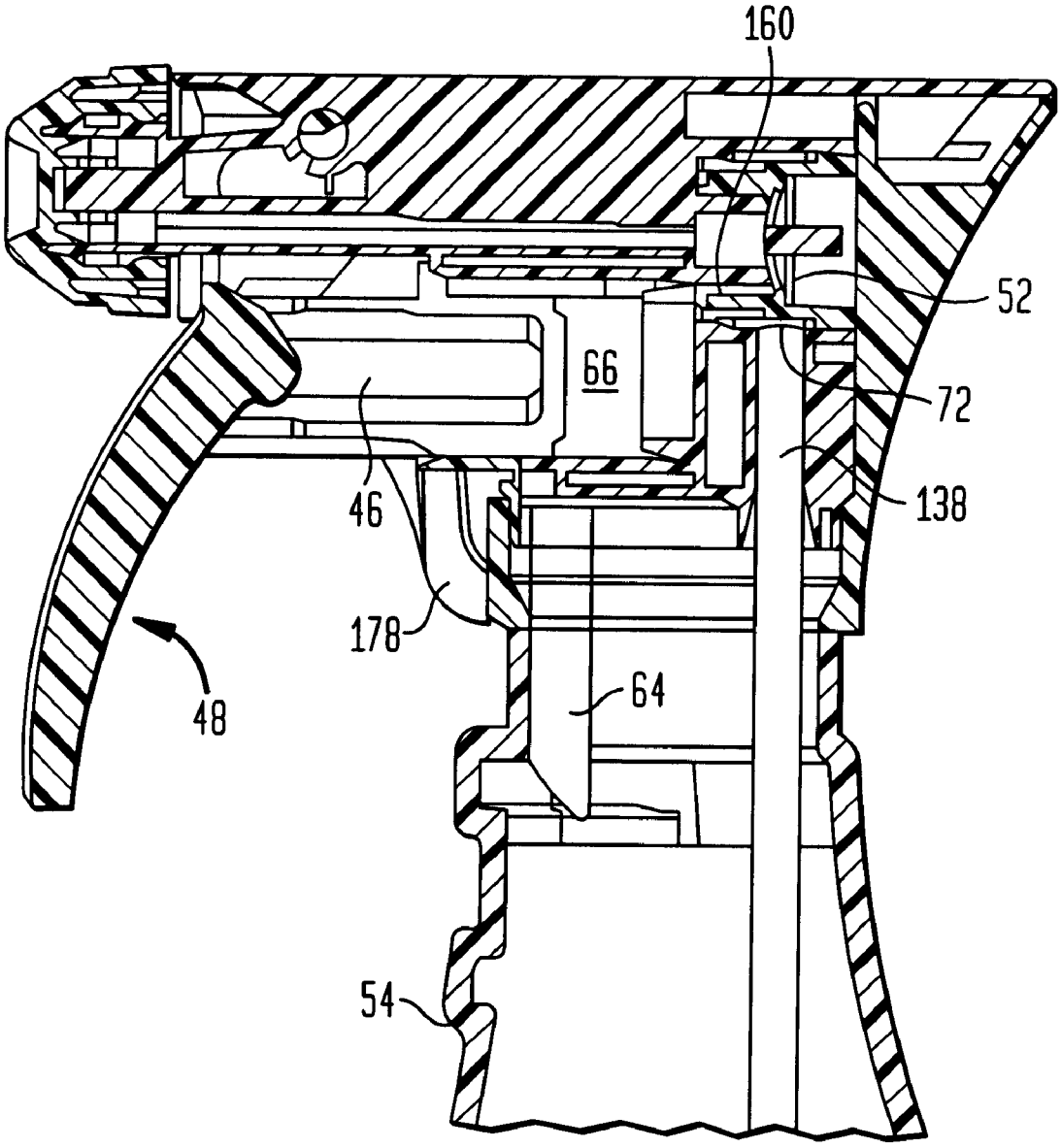
FIG. 10 shows a further step for assembling a dispenser subassembly with a dispenser.
Figure 11:
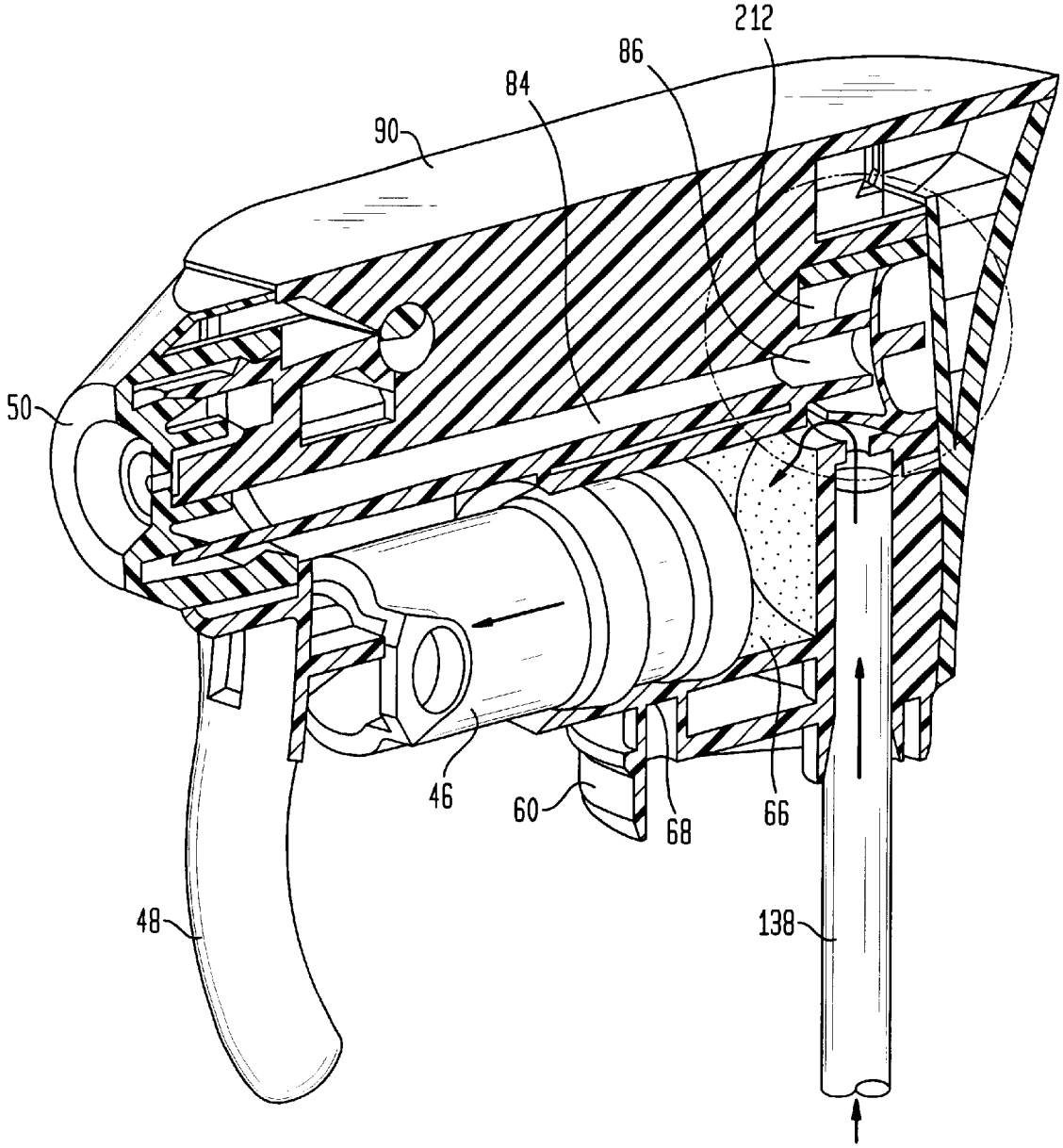
FIG. 11 shows a fragmentary cross-sectional view of the liquid dispenser of FIG. 10 during a suction stroke, in accordance with certain preferred embodiments of the present invention.
Figure 12:
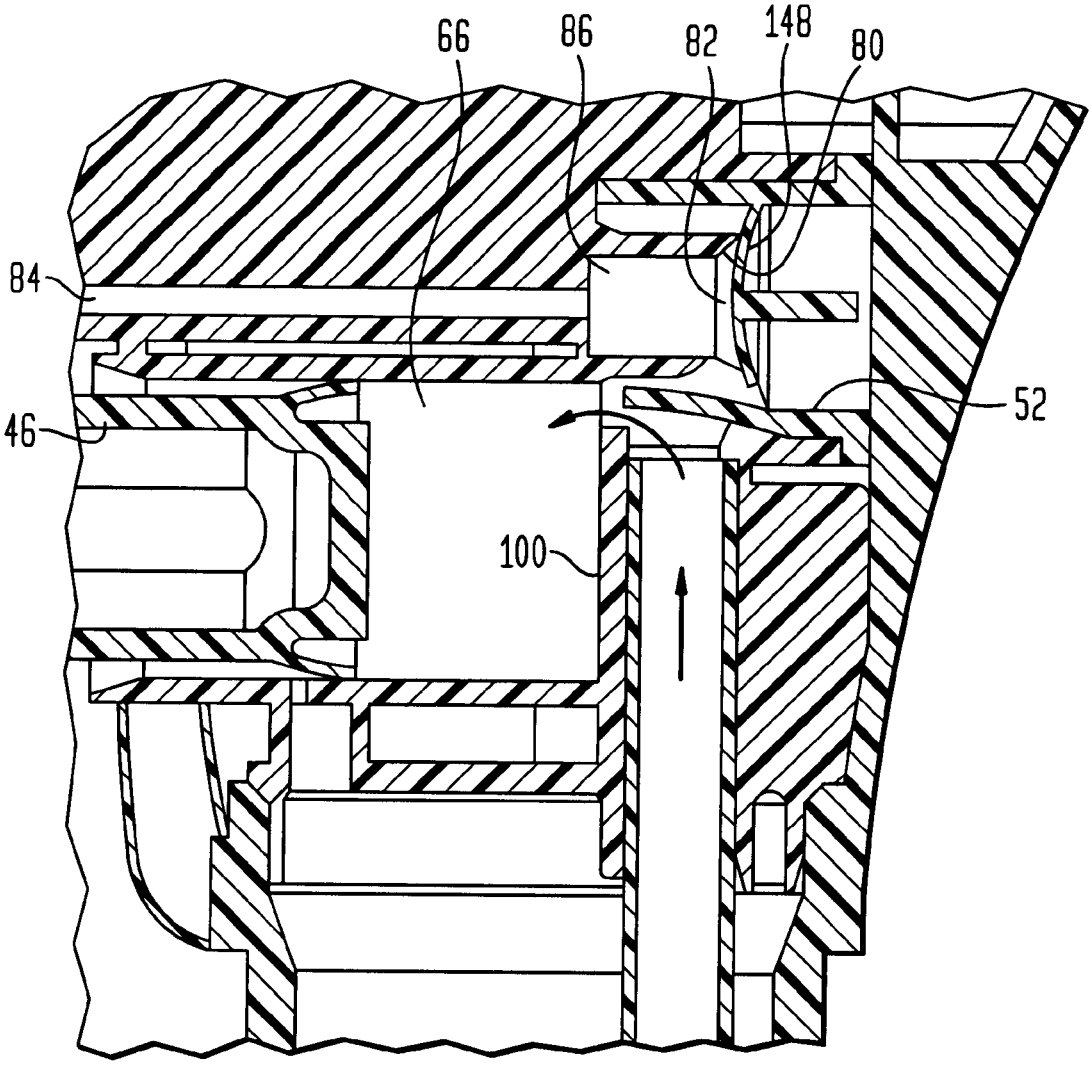
FIG. 12 shows an expanded view of the highlighted area of FIG. 11 with a dip tube shown in cross-section.

Referring to FIGS. 9 and 10, the liquid dispenser 40 is primed or charged when the dispenser subassembly 42 is assembled with the container 54. Just before final assembly, the container 54 is filled with liquid, and the trigger 48 of the dispenser subassembly 42 is moved to the rearward position shown in FIG. 9. Moving the trigger 48 to the rear causes the piston 46, which is connected to the trigger 48, to move toward the rear wall 100 of the pump chamber 66. Priming occurs when the trigger 48 is forced into the forward position shown in FIG. 10. As the dispenser subassembly is inserted into the container opening, biasing element 178 engages the rear side of the trigger, thereby forcing the trigger to move to the forward position shown in FIG. 10. Referring to FIGS. 9–12, as the trigger 48 moves forward, the trigger pulls the piston 46 away from the rear wall 100 of the pump chamber 66, creating a vacuum in the pump chamber 66. The vacuum in the pump chamber 66 pulls the peripheral flap 160 of valve 52 away from opening 72 so as to draw liquid through dip tube 138, past the peripheral flap 160 and into the pump chamber 66. The pump chamber will generally be filled with liquid once the piston 46 has reached the end of the return stroke.

Figure 13:
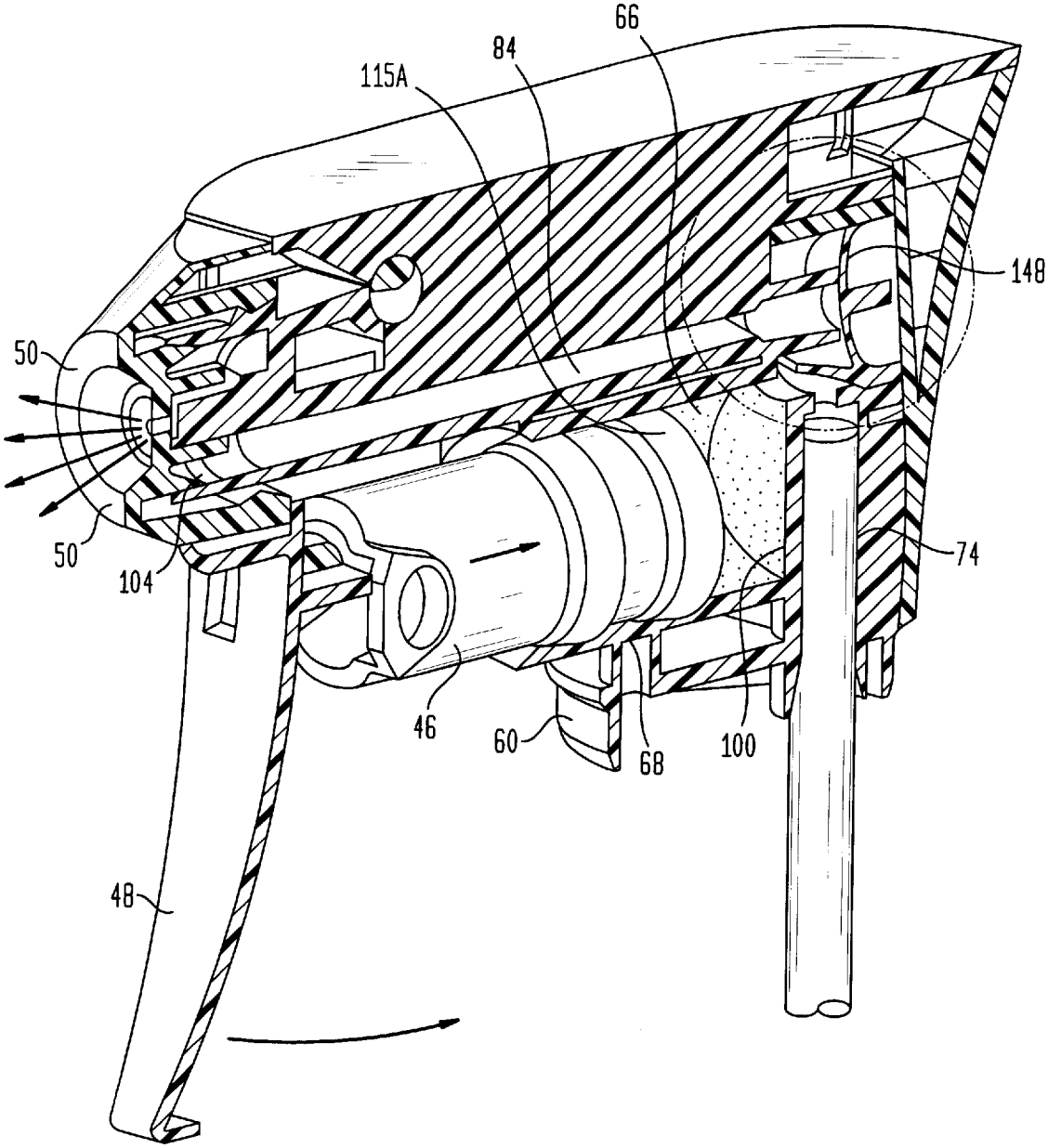
FIG. 13 shows a fragmentary cross-sectional view of the liquid dispenser of FIG. 10 during a discharge stroke, in accordance with certain preferred embodiments of the present invention.
Figure 14:
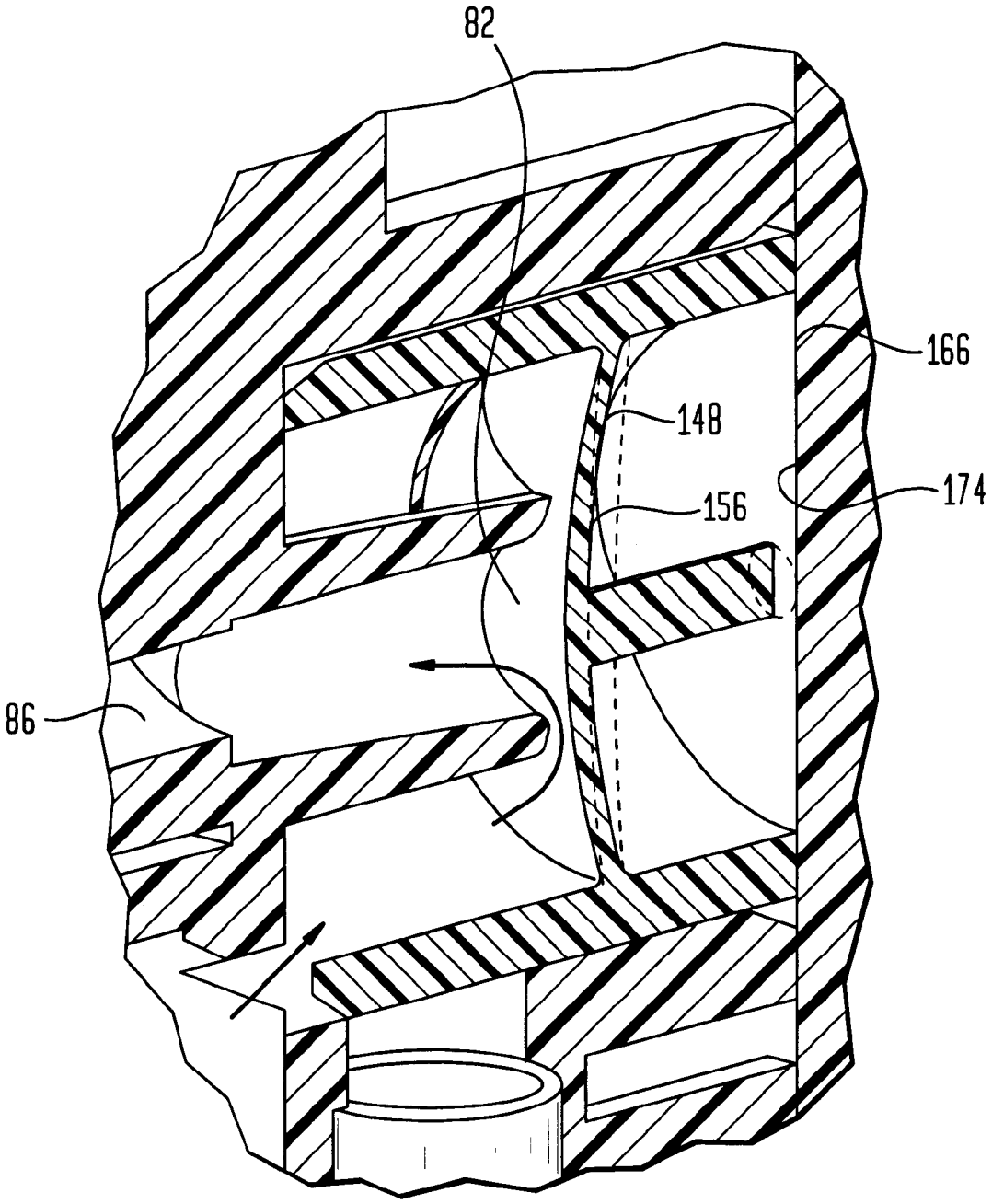
FIG. 14 shows an expanded view of the valve shown in FIG. 13.

Referring to FIGS. 13 and 14, when a user desires to discharge liquid from the liquid dispenser 40, the user pulls the trigger 48. Pulling the trigger 48 forces the piston 46 toward the rear wall 100 of the pump chamber 66, thereby reducing the volume of the pump chamber 66 and compressing the fluid and the air present in the pump chamber. The valve 52 will not open until the pressure within the pump chamber is greater than the combination of the sprint force of the diaphragm and the ambient pressure on the concave face of the diaphragm. When the pressure of the air in the pump chamber is greater than the combination of the spring force exerted by the diaphragm 148 and the pressure of the ambient air between the concave face 156 of the diaphragm and the rear wall 174 of the shroud 166, the diaphragm 148 is forced away from the opening 82 in the valve seat 80 so that the air and the liquid within the pump chamber may pass through the opening 82 at the second end 86 of the discharge conduit 84. The liquid will then pass through discharge conduit 84 onto outlet 104, where the liquid will be atomized through nozzle 50.

The liquid dispenser includes an aeration hole that prevents a partial vacuum from forming within the container during operation thereof. Referring to FIG. 13, the aeration hole 68 is provided between the pump chamber 66 and the underside of the circular member 60. During a discharge stroke, when the first flange 115A of the piston passes over the aeration hole 68 as the piston 46 moves toward the rear wall of the pump chamber 66. When the first flange 115A passes the aeration hole, the atmosphere within the container is exposed to the external atmosphere (i.e., ambient air) outside the container. Conversely, during a suction stroke (FIG. 11), the container is sealed off from the external atmosphere once the first sealing flange 115A of the piston 46 passes beyond the aeration hole 68, so that the aeration hole is between the first flange 115A and the rear wall 100 of the pump chamber 66.

Figure 15:
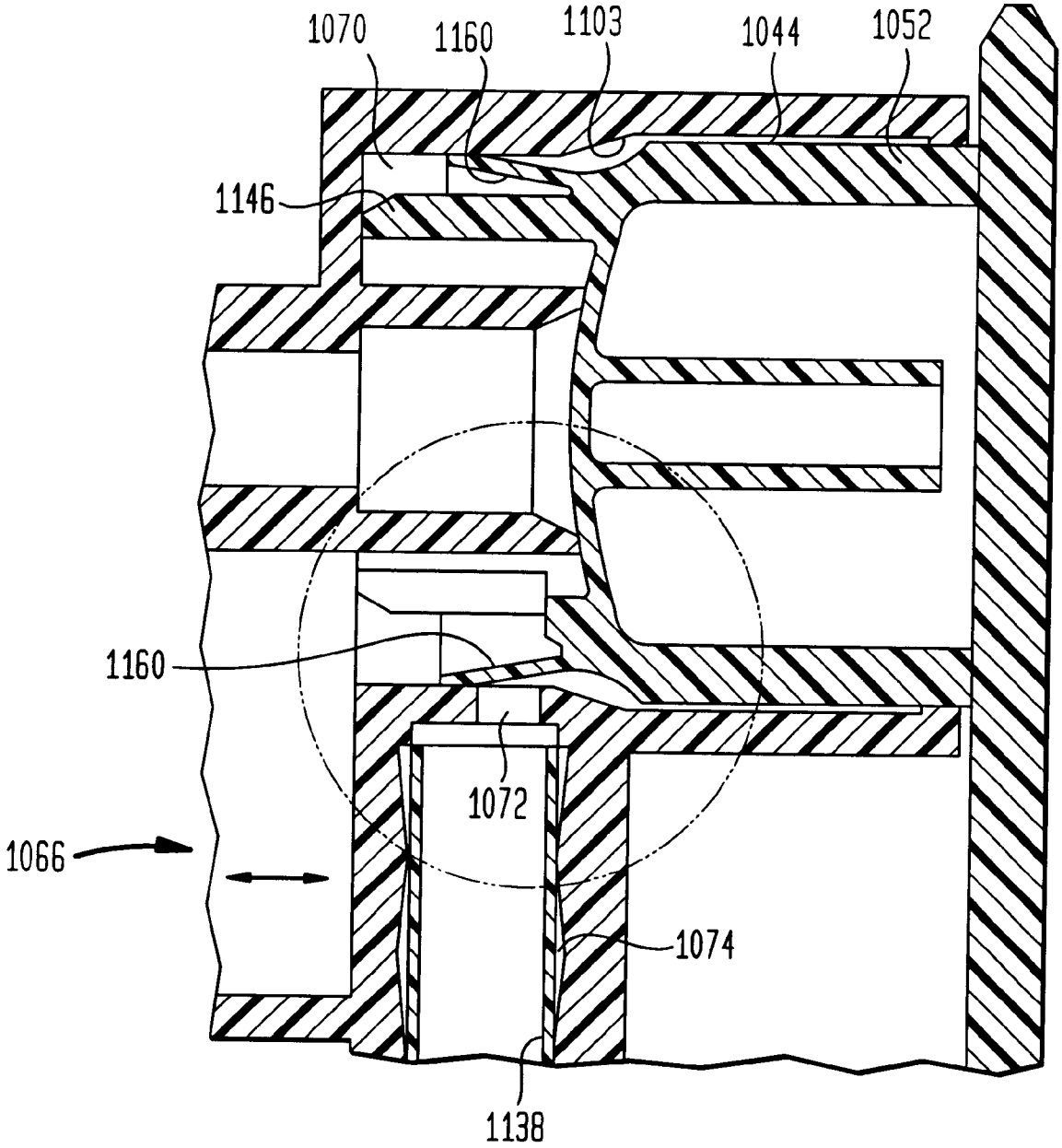
FIG. 15 shows a fragmentary cross-sectional view of precompression system for a liquid dispenser, in accordance with certain preferred embodiments of the present invention.

In another preferred embodiment of a precompression system for a liquid dispenser, as shown in FIG. 15, the exterior sleeve 1044 of the valve 1052 has no opening in fluid communication with the liquid supply passage 1074. Instead the exterior sleeve has an outwardly extending peripheral flap 1160 projecting from the first end 1146 of the valve 1052. The peripheral flap 1160 is flexible, extends completely around the outer periphery of the valve 1052, and, because it is inclined toward the internal wall of the valve chamber, normally fits snugly against the internal wall of the valve chamber. During a suction stroke, the peripheral flap is pulled away from the opening 1072 in the liquid supply passage 1074 so that liquid is able to flow through the opening 1072 and into the pump chamber 1066 by the exterior sleeve 1144 portion of the valve 1052 but is not able to flow past the second end of the valve 1152 having a larger diameter than the exterior sleeve 1144 portion. However, the liquid is able to flow by the smaller diameter exterior sleeve 1144 and the peripheral flap 1160 and into the pump chamber 1066.

The precompression system shown in FIG. 15 provides excellent sealing characteristics. Due to the sealing action of the peripheral flap 1160 of valve 1052, the pump pressure does not act on the cylindrical sleeve 1144 of the valve 1052, and therefore the risk of liquid or fluid leaking past the cylindrical sleeve 1144 is greatly reduced. Also, the sleeve may be made smaller and lighter than in previously described embodiments because there is no need for a reinforcing flange along the periphery of the sleeve. Still further, the valve 1052 is easy to manufacture by injection molding, because it does not have any side opening and its associated valve means does not require any sliding cores or mandrels to be included in the mold. In addition, the valve 1052 may be easily installed because the external sleeve 1144 is completely symmetrical along its longitudinal axis. Finally, there is no need for any opening to be aligned with the liquid supply opening 1072 communicating with the dip tube 1138.

In other preferred embodiments, the angle of inclination of the peripheral flap may be somewhat smaller than that shown in FIG. 15, whereas the interior wall of the valve chamber may have a larger inclined portion.

Figure 16A:
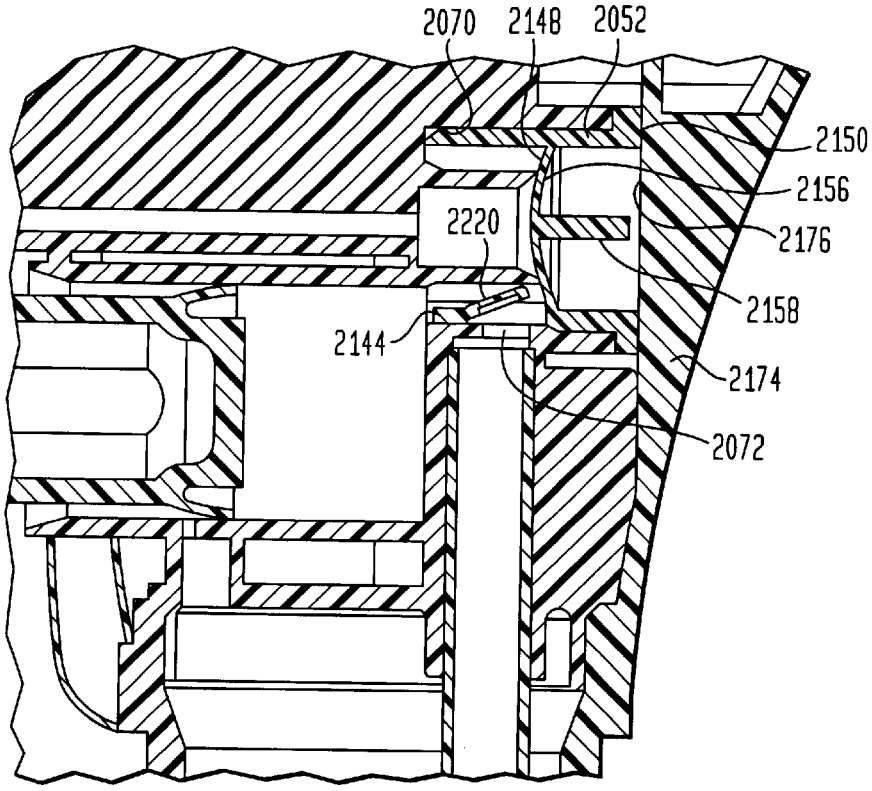
FIG. 16A shows a cross-sectional view of a precompression system for a liquid dispenser during a suction stroke, in accordance with further preferred embodiments of the present invention.
Figure 16B:
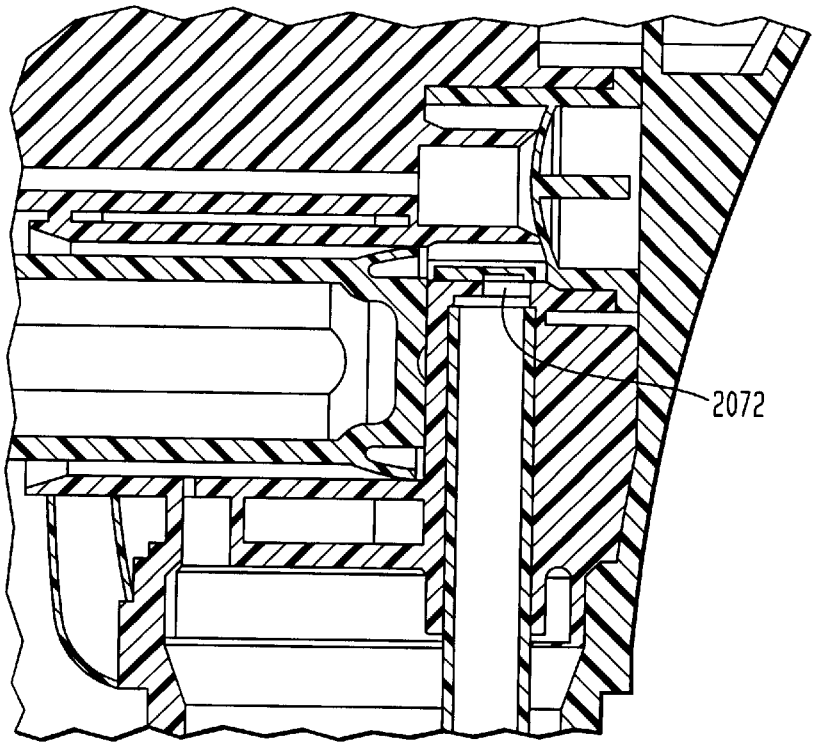
FIG. 16B shows the precompression system of FIG. 16A during a discharging stroke.

FIGS. 16A and 16B show a further preferred embodiment wherein the valve 2052 includes a flapper valve 2220 that is integrally connected with the sleeve 2144 of the valve by a hinge. The valve 2052 is pivotable between a position in which it is displaced from the liquid supply passage opening 2072 (FIG. 15A) and a position in which it seals the liquid supply passage opening 2072 (FIG. 15B). The valve also includes a stop member 2158 connected to the concave face 2156 of the diaphragm 2148. The stop member 2156 serves to limit the bending or flexing of the diaphragm 2148 and to prevent it from "flipping over" or turning inside out. The valve 2052 is locked in the valve chamber 2070 by the flat surface 2176 of end wall 2174 engaging the second end 2150 of valve 2052. The end wall 2174 prevents the valve 2052 from backing out of the valve chamber 2070 during operation of the dispenser. The end wall 2174 also engages the stop member 2156 to prevent the diaphragm from turning inside out.

Figure 17:
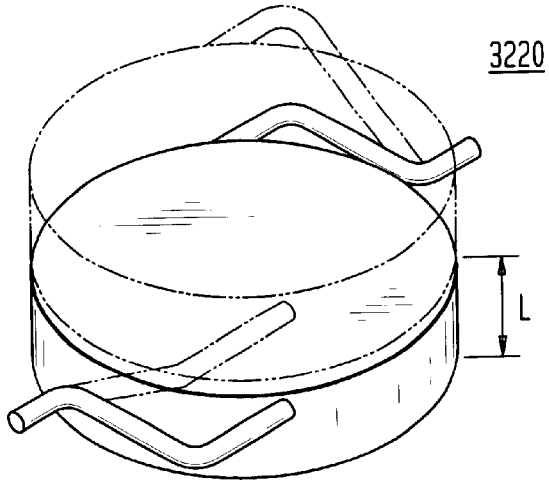
FIG. 17 shows a valve subassembly, in accordance with further preferred embodiments of the present invention.

In other preferred embodiments, the flapper valve of FIGS. 16A and 16B may be replaced by the spider valve 3220 shown in FIG. 17. Although certain preferred embodiments have been described in FIGS. 11–17, the precise shape of the valves and/or the peripheral flaps extending from the first ends of the valves is not critical so long as each valve allows liquid to enter the pump chamber via the liquid supply passage during a suction stoke and exerts sufficient pressure on the internal wall of the valve chamber to ensure a perfect seal during a discharge stroke.

Figure 18:
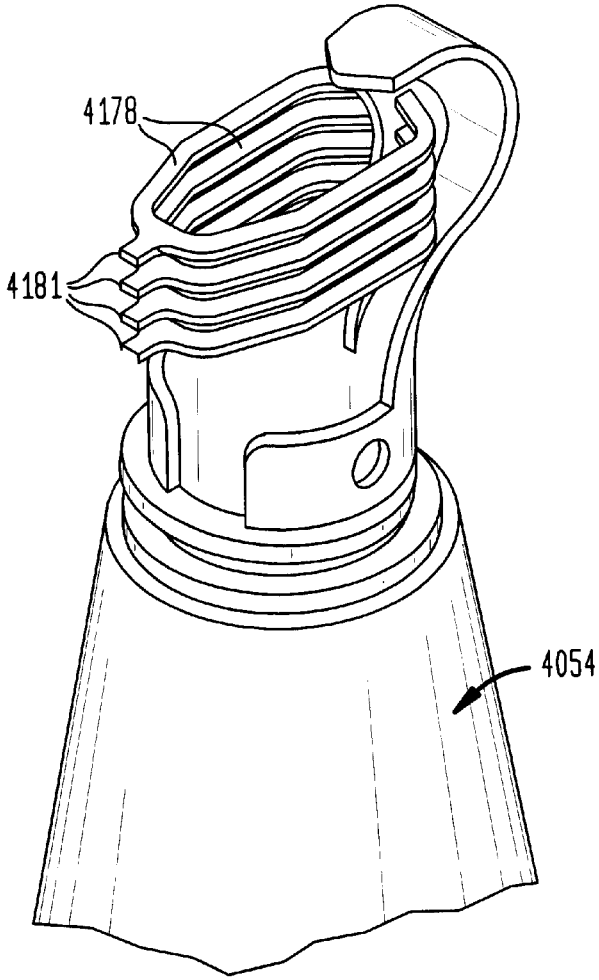
FIG. 18 shows a perspective view of a container for a liquid dispenser, in accordance with further preferred embodiments of the present invention.
Figure 19:
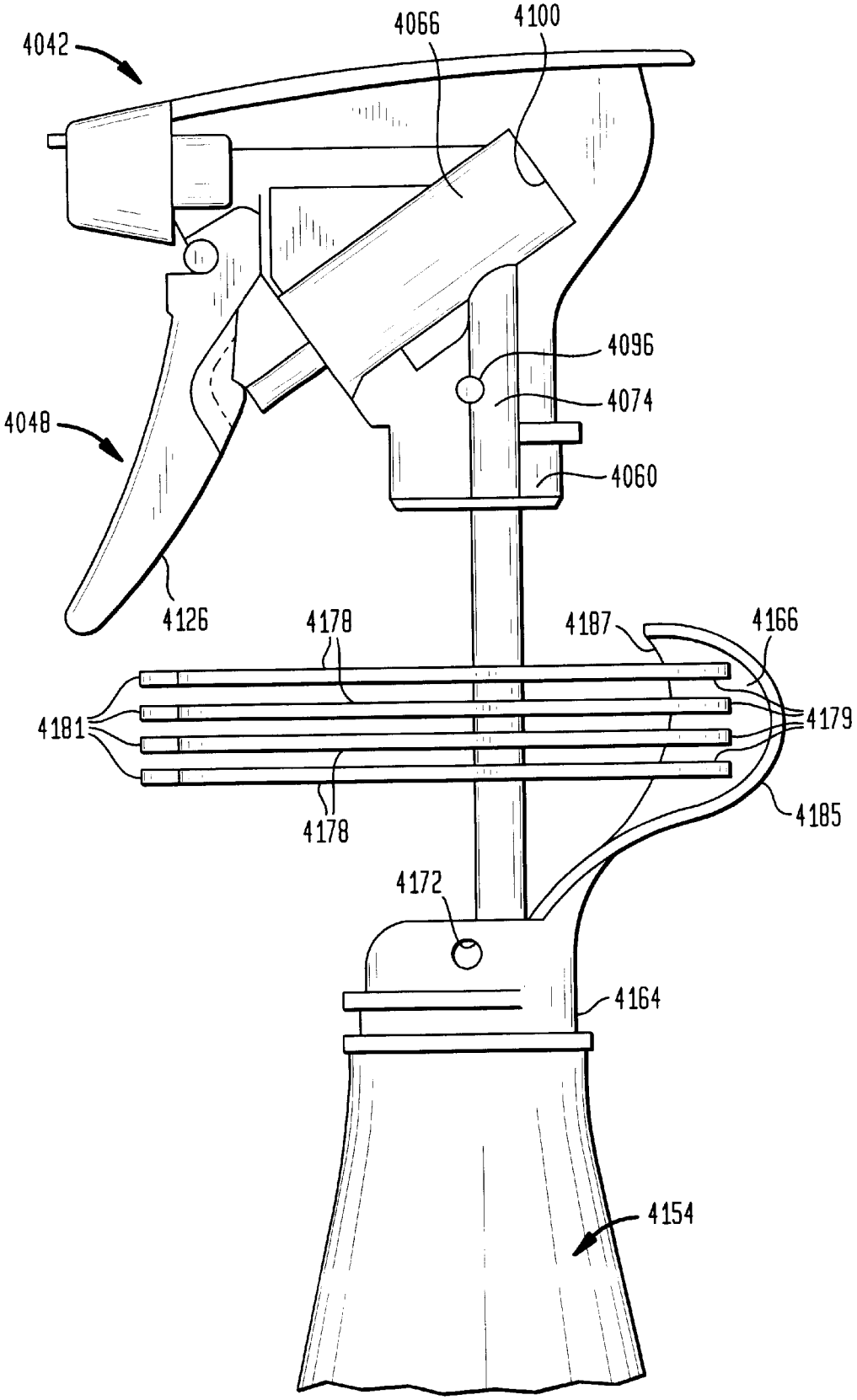
FIG. 19 shows the container of FIG. 18 being assembled with a dispenser subassembly, in accordance with still further preferred embodiments of the present invention.
Figure 20:
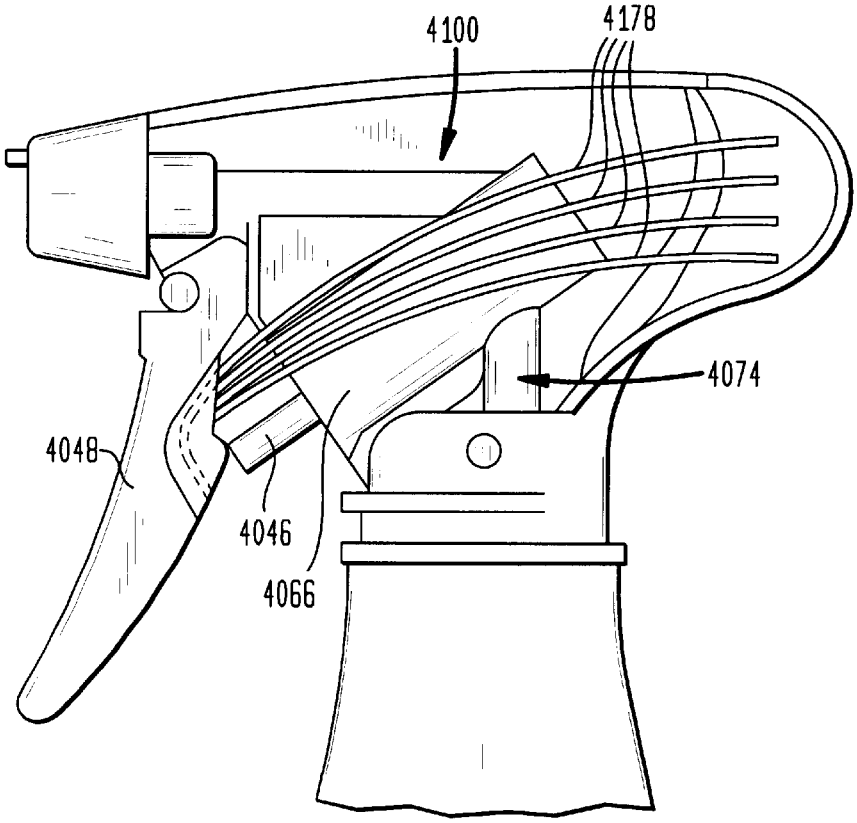
FIG. 20 shows the liquid dispenser of FIG. 19 after the dispenser subassembly has been connected to the container.

Referring to FIGS. 18–20, in a further preferred embodiment the actuating element includes a pair of parallel, flexion springs 4178 that are adapted for engaging channels provided in the rear surface 4126 of the trigger 4048. The springs 4178 each have a closed contour configuration and are fixed on one end 4179 to a column 4166 that extends upwardly from the container neck 4164. The opposite end of each spring 4178 has a protrusion 4181 adapted for engaging the chamber in the rear of the trigger 4048. The column 4166 includes of a curved web 4185 and a reinforcing rib 4187 arranged therein, and has a substantially cylindrical base 4189 which is attached to the neck 4164 of the container 4054. The base 4189, the column 4166 and the springs 4178 are integrally molded with the container 4054. Two opposite opening 4172 are provided in the base 4189 and are arranged to cooperate with two protruding snap members 4096 on the dispenser subassembly 4042. Referring to FIG. 19, when assembling the subassembly 4042 to the container 4054, the flexion springs 4178 are introduced into the channels at the rear 4126 of the trigger 4048. To this end, the piston 4046 must be moved to its outermost position within the pump chamber 4066. The subassembly 4042 may be connected to the container 4054 by inserting tabs 4096 engaging into openings 4172.

Referring to FIG. 20, during a pumping stroke, when the trigger 4048 is pressing the piston 4046 into the pump cylinder 4066, the springs 4178 are compressed. When the pressure on the trigger 4048 is released, the trigger is forced back to the charged position by the bias force of the springs. Because the trigger 4048 is connected to the piston 4046, as the trigger is forced back toward the charged position, the trigger will pull the piston away from the rear wall 4100 of the pump chamber 4066, thereby creating suction in the pump chamber 4066 and drawing liquid through the liquid supply passage 4074.

Figure 21:
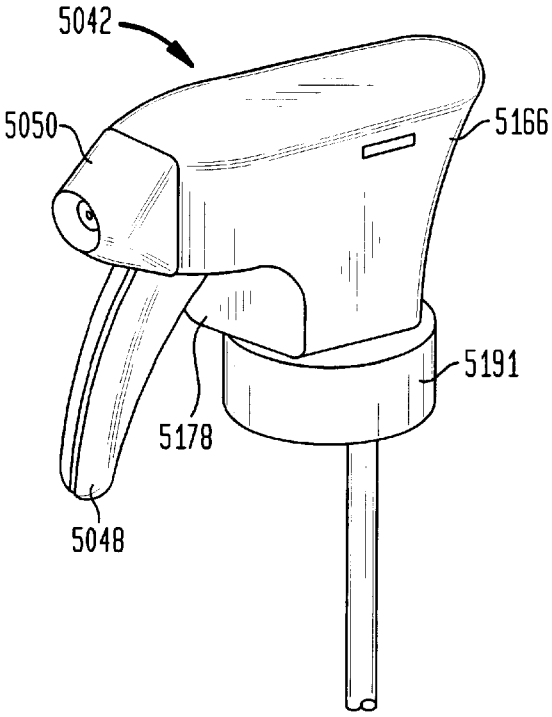
FIG. 21 shows a dispenser subassembly and an actuating element, in accordance with further preferred embodiments of the present invention.
Figure 22:
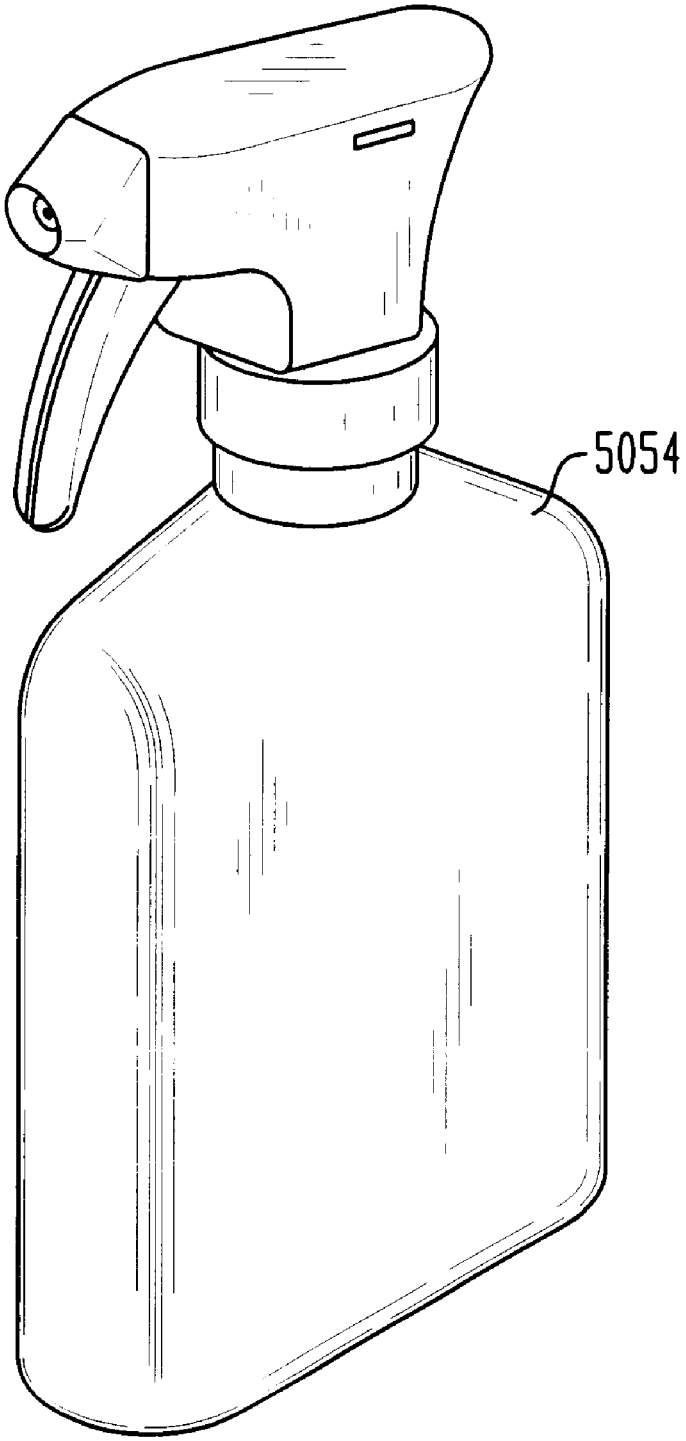
FIG. 22 shows the dispenser subassembly and the actuating element of FIG. 21 after the dispenser subassembly and the actuating element have been assembled with a container.

Referring to FIGS. 21 and 22, in further preferred embodiments of the present invention, the dispenser subassembly 5042 may be connected with conventional containers 5054 having necks with screw threads or bayonet connector type necks. In this particular embodiment, the dispenser subassembly 5042 having trigger 5048 and nozzle 5050 is secured within shroud 5166 integrally connected to ring 5191. An actuating element 5178, such as biasing springs, is not preassembled or integrated with the container 5054, as shown above, but rather with the separate ring 5191. The ring or cap may be fixed to the container 5054 before the dispenser subassembly is secured to the container and the ring. Although some of the advantages set forth above may be lost, the advantages related to a liquid dispenser having a limited number of parts remain.

FIGS. 23–29 show a liquid dispenser 6040 in accordance with further preferred embodiments of the present invention. Referring to FIGS. 24A and 24B, the liquid dispenser includes a dispenser subassembly 6042 including a housing 6044 having a liquid supply passage 6074, a valve chamber 6070, a pump chamber 6066 and a discharge conduit 6084 including a discharge outlet 6104. The housing 6044 includes two cylindrical shaped chambers arranged next to each other, the pump chamber 6066 and the vent chamber 6068.

Figure 23:
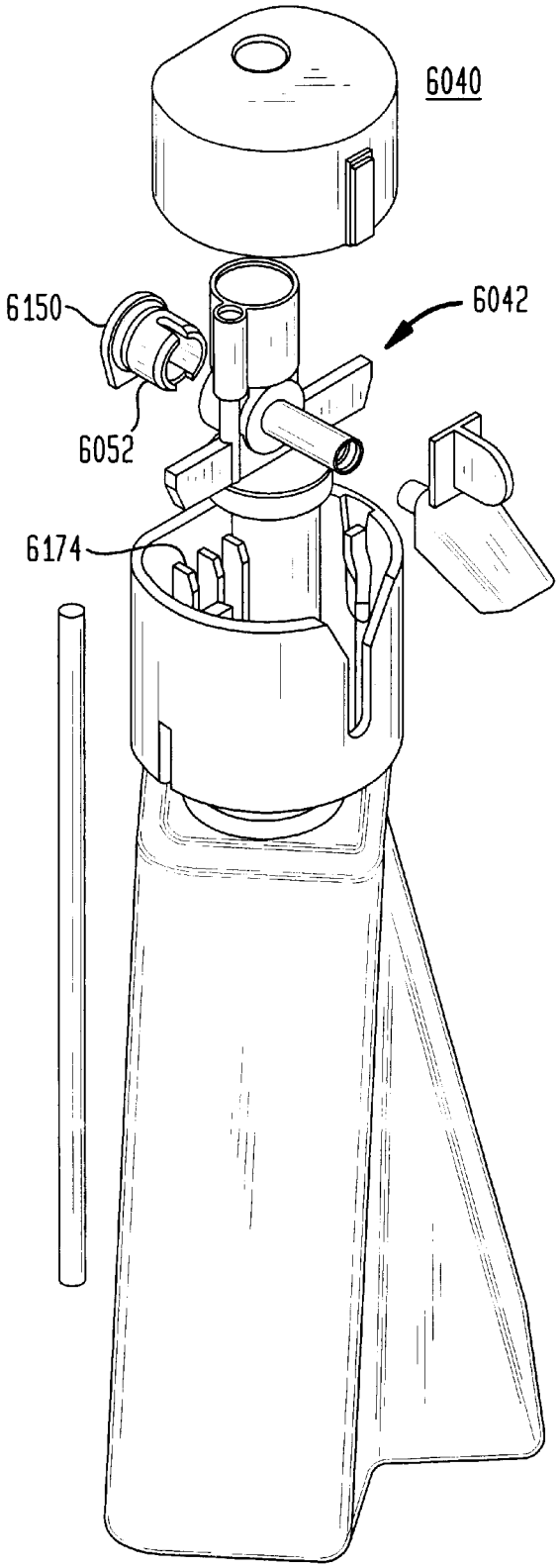
FIG. 23 shows an exploded view of a liquid dispenser including a housing, a movable element, a valve, a dip tube, a locking element and a container, in accordance with further preferred embodiments of the present invention.
Figure 24A:
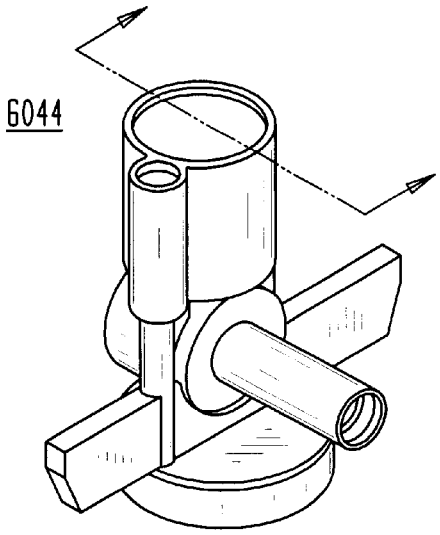
FIG. 24A shows a perspective view of the housing shown in FIG. 23.
Figure 24B:
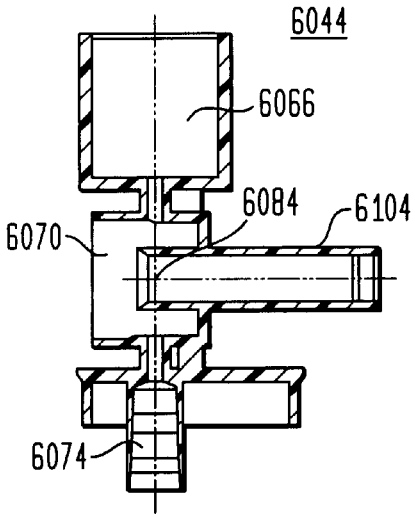
FIG. 24B shows a cross-sectional view of the dispenser housing of FIG. 24A.
Figure 25A:
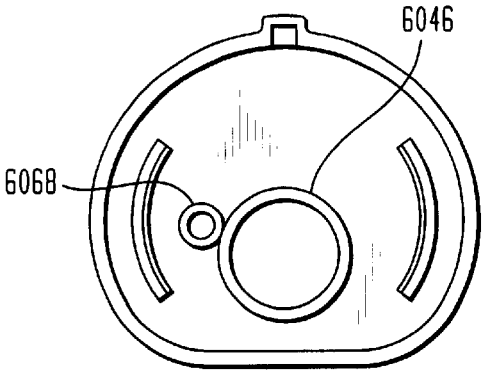
FIG. 25A shows a bottom view of the movable element shown in FIG. 23.
Figure 25B:
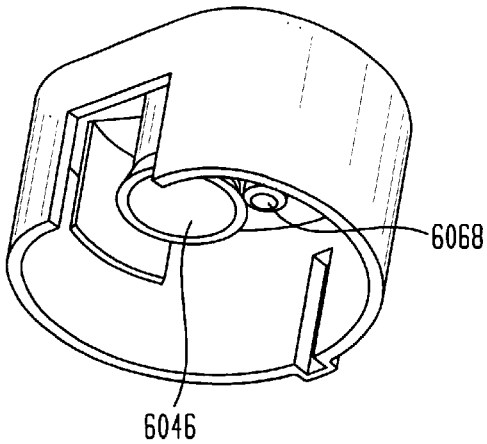
FIG. 25B shows a perspective view of the movable element shown in FIG. 23.

Referring to FIGS. 23 and 25A–25B, the liquid dispenser 6040 includes a moving member 6048 for operating a pump so as to draw liquid through the liquid supply passage 6074 and, after sufficient pressure has been built up to overcome the normally closed valve 6052, discharge the liquid through the discharge conduit 6084. The moving member 6048 includes a first plunger 6046 adapted for reciprocating movement in the pump chamber 6066 and a second plunger 6047 adapted for reciprocating movement in the vent chamber 6068. Both plungers are operated by the moving member 6048 as the moving member reciprocates up and down in the chambers. The plungers may be rigidly connected to, or integrally formed with, the moving member.

Figure 27:
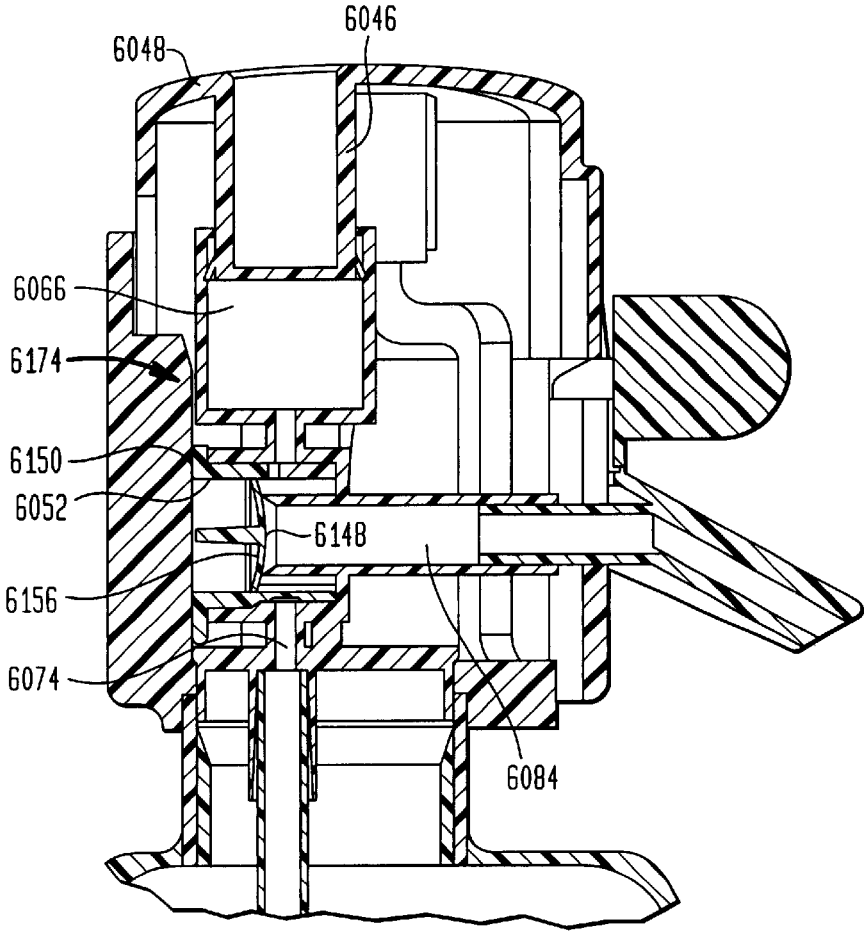
FIG. 27 shows a fragmentary cross-sectional view of the liquid dispenser of FIG. 23 after final assembly thereof.
Figure 26A:
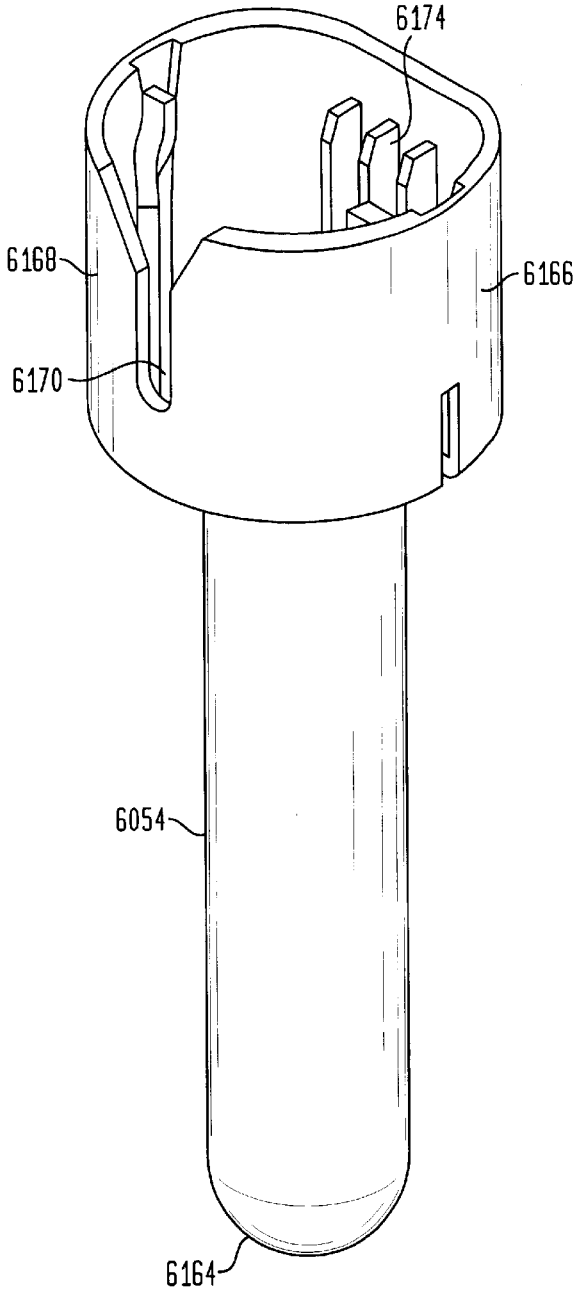
FIG. 26A shows a perspective view of the container shown in FIG. 23.
Figure 26B:
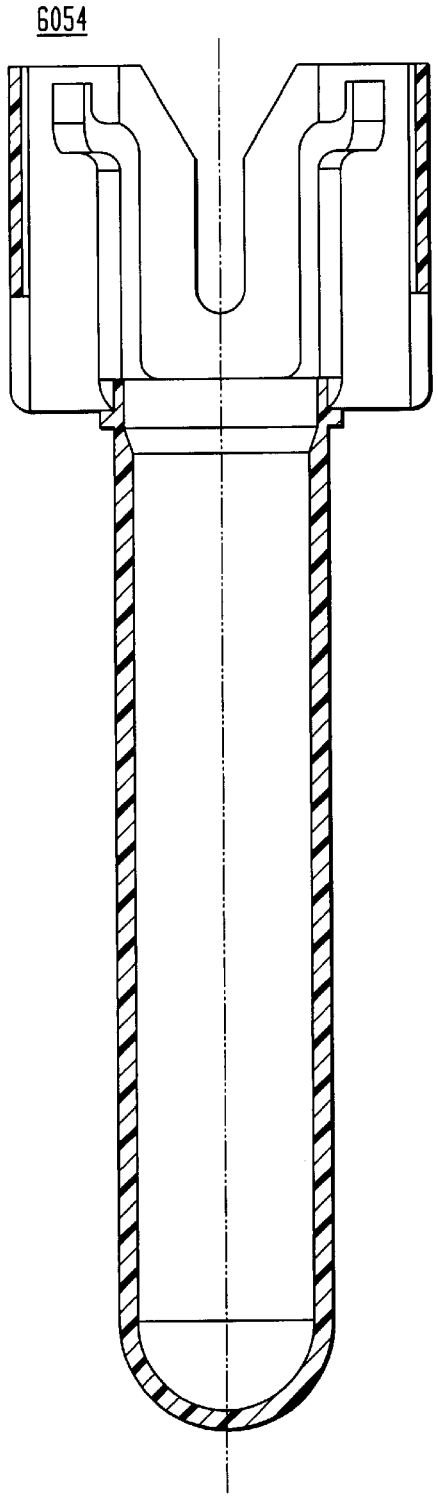
FIG. 26B shows a cross-sectional view of the container shown in FIG. 27A.

Referring to FIGS. 26A and 26B, the container 6054 preferably includes an upper end 6162 and a lower end 6164 remote therefrom. The container has an opening 6056 at its upper end 6162. The opening may be reinforced by a circular ring 6164 integrally molded and/or attached to the tipper end of the container. The container includes a shroud 6166 extending upwardly from the upper end thereof. The shroud preferably has a front-end 6168 with a depression 6170 for allowing the discharge outlet 6104 to extend therethrough. The shroud also includes rear support ribs 6174 extending in a direction substantially parallel to the longitudinal axis of the container. Referring to FIGS. 23 and 27, when the housing 6044 is secured to the container, the rear support ribs 6174 closely engage the second end 6150 of the valve 6052. The rear support ribs 6174 of the essentially lock the valve 6052 within the valve chamber 6070 and allow the concave face 6156 of the diaphragm 6148 to be exposed to atmospheric pressure. In certain embodiments, the container may comprise a preform having a test tube shape that is blow molded into its final shape shortly before being filled and assembled with the dispenser subassembly.

Referring to FIGS. 26A–26B and 27, the container 6054 also includes an actuating element preassembled therewith adjacent the opening 6056. The actuating element includes two flexible arms 6178 and 6178 having lower ends 6180 integrally connected to the container 6054 and upper ends 6182 extending away from the container 6054. After assembly, the biasing element 6178 engages the underside of the movable member 6048 for urging the movable member to return to an extended or charged position, as will be described in more detail below.

Reciprocating movement of the movable member 6048 between its two positions also reciprocates the pump plunger 6046 and the vent plunger 6068 in their respective pump and vent chambers. During a suction stroke, the pump plunger moves in an upward direction to create a vacuum in the pump chamber 6066, thereby drawing liquid through liquid supply passage 6074 and into the pump chamber 6066. During a discharge stroke, the pump plunger 6046 moves in a downward direction to reduce the volume of the pump chamber 6066. Once the pressure within the pump chamber is greater than the combined force of the diaphragm 6148 and the ambient pressure on the concave face 6156 of the diaphragm, the diaphragm is forced away from the valve seat 6080 and the liquid is free to pass by the valve seat and into the discharge conduit 6084.

Figure 28:
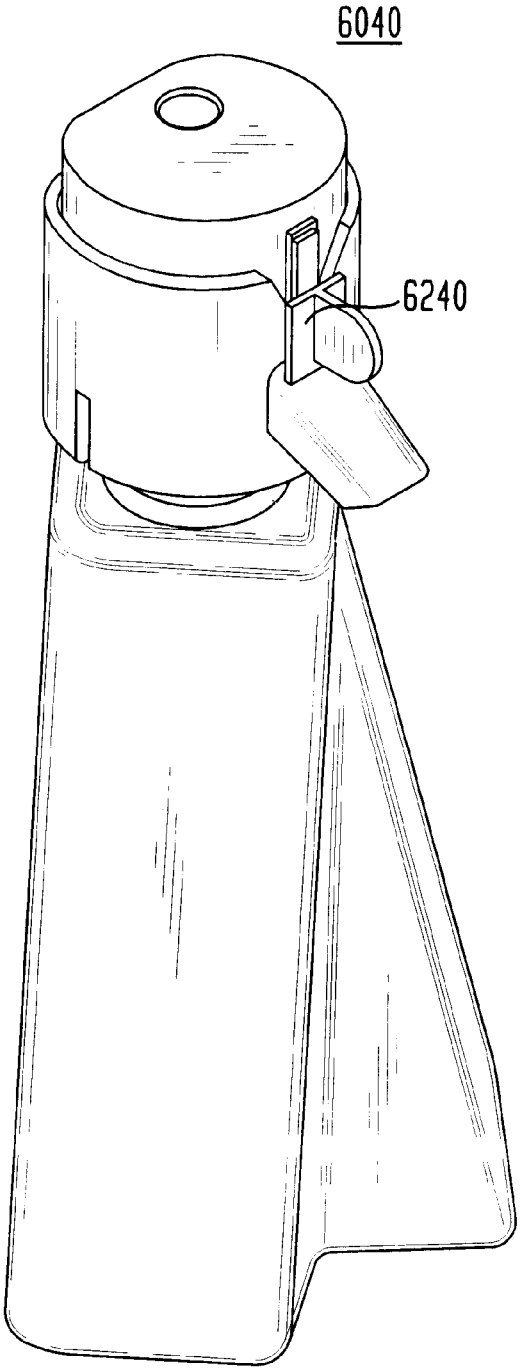
FIG. 28 shows a perspective view of the liquid dispenser of FIG. 27 including a locking element.
Figure 29:
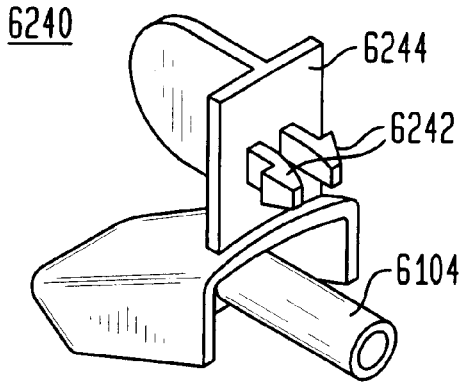
FIG. 29 shows an expanded view of the locking element of FIG. 28.

Referring to FIGS. 28 and 29, the liquid dispenser 6040 also includes a locking element 6240 which prevents unauthorized use of the dispenser or which renders such use detectable. In one embodiment, the locking element 6240 includes two frangible tongues 6242 that is arranged in the path of the movable member 6048 and that are integrally formed with the discharge tube 6104. The tongues 6242 are arranged on a gripping part 6244 that may removed (i.e., torn off) by a user so that the movable member 6048 may be pressed down for operating the liquid dispenser. An inspection of the dispenser before use will reveal tampering if the tongues have already been removed. In other preferred embodiments, the locking element may be integrally formed with the discharge conduit so that the number of parts required for the liquid dispenser may be further reduced. In yet further preferred embodiments, the locking element may include a cover that is hingedly connected to the pump and that closes off the discharge outlet, thereby preventing the operating element from further movement.

Although the invention has been illustrated by means of a number of examples, it should be apparent that it is not limited thereto. For example, other parts of the dispenser subassembly head might be integrated with the container, such as the pump chamber. Moreover, the container might be blow molded at a different location than at the final filling and assembly line. Furthermore, the flexible diaphragm and sleeve of the spring valve could be formed separately. In addition, spring valve may not include a stop member in some instances and the choice of materials might be varied as well. Accordingly, the scope of the invention is defined solely by the appended claims.

What is claimed is:

1. A precompression system for a liquid dispenser having an inlet and an outlet, the precompression system comprising:

a pump chamber including a piston movable in the pump chamber for drawing liquid through the inlet and discharging the liquid through the outlet; and a valve chamber including a spring valve disposed between the pump chamber and the outlet and being operable to allow liquid in the pump chamber to reach the outlet only after a predetermined pressure is established in said pump chamber and to stop liquid from reaching the outlet when the pressure in the pump chamber falls below said predetermined pressure, wherein said spring valve includes a peripheral flap extending from a first end thereof for selectively closing the inlet, and wherein the valve chamber is not in alignment with the pump chamber.

2. The precompression system as claimed in claim 1, wherein the valve chamber is in fluid communication with said pump chamber and includes a valve seat having an opening extending therethrough, said valve chamber having a first end adjacent the valve seat, a second end remote therefrom and an interior wall extending therebetween.

3. The precompression system as claimed in claim 2, wherein the spring valve is disposed in said valve chamber, said spring valve having the first end including a resilient diaphragm normally closing the valve seat opening and a second end remote therefrom.

4. The precompression system as claimed in claim 3, wherein said diaphragm includes a convex surface facing the valve seat opening and in fluid communication with the pump chamber and a concave surface in fluid communication with atmospheric pressure.

5. The precompression system as claimed in claim 4, wherein the concave surface of the diaphragm includes a stop member connected thereto for limiting the flexibility of the diaphragm away from the valve seat.

6. The precompression system as claimed in claim 5, wherein the peripheral flap of the spring valve surrounds the outer periphery of the flexible diaphragm.

7. The precompression system as claimed in claim 6, wherein the peripheral flap is flexible and inclines toward the interior wall of the valve chamber.

8. The precompression system as claimed in claim 7, wherein the peripheral flap seals the inlet during a pump discharge stroke.

9. The precompression system as claimed in claim 7, wherein the peripheral flap is movable away from the inlet when the pump moves from a second position to a first position so that liquid may be drawn into the pump chamber.

10. The precompression system as claimed in claim 9, wherein the peripheral flap is engagable with the interior wall of the valve chamber during a discharge stroke and is remote from the interior wall during a suction stroke.

11. The precompression system as claimed in claim 10, wherein the precompression system is provided in a dispenser subassembly having the inlet and the outlet.

12. The precompression system as claimed in claim 11, wherein the dispenser subassembly is adapted for being at least partially secured within a container having an opening, the container including a shroud connected thereto that extends upwardly from the container and that at least partially surrounds the opening thereof, the shroud including an end wall integrally molded therein, wherein when the dispenser subassembly is at least partially secured in the container the end wall of the shroud is in alignment with the valve chamber and in contact with the second end of the spring valve for securing the spring valve within the valve chamber.

13. The precompression system as claimed in claim 12, wherein the convex face of the diaphragm is in contact with the liquid stored in the pump chamber.

14. The precompression system as claimed in claim 13, wherein the concave face of the diaphragm is forced away from the opening of the valve seat when the pressure within the pump chamber is greater than the spring force of the spring valve and the atmospheric pressure in contact with the concave face of the diaphragm.

15. The precompression system as claimed in claim 14, wherein the diaphragm is dome-shaped.

16. A precompression system for a liquid dispenser having a dispenser subassembly and a container comprising:

said dispenser subassembly comprising a housing including an inlet for drawing a liquid into the housing, an outlet for discharging the liquid from the housing, and a pump including a pump chamber in fluid communication with the inlet and the outlet;

said container including an opening for receiving a liquid and having an actuating element connected thereto, said actuating element being engageable with said dispenser subassembly when said container and said dispenser subassembly are assembled together; and said precompression system disposed in the dispenser subassembly and in fluid communication with the pump chamber, wherein the precompression system is operable for allowing liquid entering the inlet to reach the outlet only after a predetermined pressure is established in the pump chamber and to stop the liquid from reaching the outlet when the pressure in the pump chamber falls below the predetermined pressure, wherein said precompression system includes a spring valve disposed between the pump chamber and the outlet, said spring valve having a first end including a peripheral flap extending from the first end for selectively closing the inlet.

17. The precompression system as claimed in claim 16, wherein said housing has a front, a rear, two lateral sides extending between the front and the rear, an upper end and a lower end.

18. The precompression system as claimed in claim 17, wherein said pump chamber has a first end facing the front of the housing, a second end remote therefrom and an interior wall extending between the first and second ends of the pump chamber, said pump being movable between a first position and a second position.

19. The precompression system as claimed in claim 18, wherein said actuating clement includes a biasing element engagable with said dispenser subassembly for urging said pump into one of the first and second positions.

20. The precompression system as claimed in claim 19, wherein said biasing clement is connected to said container adjacent the opening.

21. The precompression system as claimed in claim 17, wherein said container includes a shroud extending away from and at least partially surrounding the opening.

22. The precompression system as claimed in claim 21, wherein said shroud is engagable with said dispenser subassembly when said dispenser subassembly and said container are assembled together.

23. The precompression system as claimed in claim 21, wherein said shroud includes a lower end integrally connected with said container adjacent the opening and an upper end remote therefrom.

24. The precompression system as claimed in claim 23, wherein said shroud includes a front, a rear and two side sections extending between the front and the rear, and an interior surface surrounding the container opening and the biasing element.

25. The precompression system as claimed in claim 24, wherein the first end of the pump chamber is open and the second end of the pump chamber is substantially closed.

26. The precompression system as claimed in claim 25, wherein said pump further comprises a piston movable between the first and the second ends of said pump chamber.

27. The precompression system as claimed in claim 26, wherein the liquid dispenser is charged when the piston is at the first end of the pump chamber and discharged when the piston is at the second end of the pump chamber.

28. The precompression system as claimed in claim 26, wherein the liquid is drawn into the pump chamber when piston moves from the second position to the first position.

29. The precompression system as claimed in claim 28, wherein the liquid is discharged from the pump chamber when the piston moves from the first position to the second position.

30. The precompression system as claimed in claim 26, wherein said piston includes a piston rod having first and second annular sealing elements adapted for engaging the interior wall of said pump chamber.

31. The precompression system as claimed in claim 18, wherein the precompression system includes a valve chamber formed in the housing having a first end facing the rear of said housing, a second end remote therefrom, and an interior wall extending between the first and second ends thereof.

32. The precompression system as claimed in claim 31, wherein the second end of said valve chamber includes an end wall having a valve seat and an opening extending through the center of said valve seat.

33. The precompression system as claimed in claim 32, wherein the end wall at the second end of the valve chamber includes an opening in fluid communication with the pump chamber.

34. The precompression system as claimed in claim 33, wherein the spring valve includes a flexible diaphragm engageable with the valve seat.

35. The precompression system as claimed in claim 34, wherein said spring valve has the first end including the flexible diaphragm, a second end remote therefrom, and an exterior sleeve extending between the first and second ends.

36. The precompression system as claimed in claim 35, wherein the container includes a shroud extending away from and at least partially surrounding the opening of said container.

37. The precompression system as claimed in claim 36, wherein said shroud includes an interior surface engaging said dispenser subassembly when said dispenser subassembly and said container are assembled together, wherein the interior surface of said shroud contacts the second end of said spring valve for securing said spring valve within said valve chamber.

38. The precompression system as claimed in claim 34, wherein the flexible diaphragm includes a convex surface facing the valve seat and a concave surface facing away from the valve seat.

39. The precompression system as claimed in claim 38, wherein the convex surface of the diaphragm is in fluid communication with the pump chamber.

40. The precompression system as claimed in claim 39, wherein the convex surface of the diaphragm is forced away from the seat valve opening when the pressure within the pump chamber is greater than the combined force of the diaphragm and the ambient pressure cavity.

41. The precompression system as claimed in claim 38, wherein the diaphragm is dome-shaped.

42. The precompression system as claimed in claim 38, wherein a stop member is integrally formed on the concave face of the diaphragm.

43. The liquid dispenser as claimed in claim 38, wherein the flexible diaphragm is engageable with the valve seat and normally closes the opening in the valve seat.

44. The precompression system as claimed in claim 43, wherein the diaphragm is in substantial alignment with the outlet of said housing.

45. The precompression system as claimed in claim 16, wherein said actuating element is integrally connected to said container.

46. The precompression system as claimed in claim 16, wherein said container and said actuating element comprise resilient thermoplastic material.

* * * * *

UNITED STATES PATENT AND TRADEMARK OFFICE

CERTIFICATE OF CORRECTION

PATENT NO. : 6,378,739 B1
DATED : April 30, 2002
INVENTOR(S) : Maas et al.

It is certified that error appears in the above-identified patent and that said Letters Patent is hereby corrected as shown below:

Column 8,
Line 10, insert a -- , -- after “valve”.
Line 22, change “ump” to -- pump --.

Column 20,
Line 59, change “clement” to -- element --.

Signed and Sealed this

Twenty-sixth Day of November, 2002

*Attest:*

*Attesting Officer*

JAMES E. ROGAN
*Director of the United States Patent and Trademark Office*